United States Patent [19]

Kunikane et al.

[11] 4,315,068

[45] Feb. 9, 1982

[54] PHOTO-SENSITIVE AND HEAT-SENSITIVE COMPOSITION AND RECORDING ELEMENT USING SAME

[75] Inventors: Makoto Kunikane, Chigasaki; Masaakira Umehara, Yokohama; Koji Uji-Ie, Hino; Kiyoshi Taniguchi, Yokohama, all of Japan

[73] Assignee: Ricoh Co., Ltd., Tokyo, Japan

[21] Appl. No.: 229,216

[22] Filed: Jan. 28, 1981

[30] Foreign Application Priority Data

| | | | |
|---|---|---|---|
| Feb. 5, 1980 | [JP] | Japan | 55-12629 |
| May 15, 1980 | [JP] | Japan | 55-63411 |
| May 28, 1980 | [JP] | Japan | 55-70945 |

[51] Int. Cl.[3] ..... G03C 5/24; G03C 1/00

[52] U.S. Cl. ..... 430/341; 430/338; 430/936

[58] Field of Search ..... 430/338, 341, 936, 541, 430/332

[56] References Cited

U.S. PATENT DOCUMENTS

| | | | |
|---|---|---|---|
| 4,201,588 | 5/1980 | Adin | 430/936 |
| 4,243,737 | 1/1981 | DoMinH | 430/341 |
| 4,271,251 | 6/1981 | Aotani et al. | 430/338 |

*Primary Examiner*—Mary F. Downey

*Attorney, Agent, or Firm*—Blanchard, Flynn, Thiel, Boutell & Tanis

[57] ABSTRACT

A photo-sensitive and heat-sensitive composition consisting essentially of (a) a photooxidant, (b) a color-generator generating color when oxidized, (c) an acid promoting said color generation, (d) a cobalt (III) ammine and/or amine complex, (e) a photoreductant, (f) a hydrogen donator, (g) at least one kind of chelating agent selected from dioxime chelating agents having the general formula (I):

(I)

(wherein n is an integer of 0 to 3, and $R_1$ and $R_2$ can each represent an alkyl, aryl or aralkyl group) and diantipyrylmethane chelating agents having the general formula (II):

(II)

(wherein $R_3$, $R_4$, $R_5$, $R_3'$, $R_4'$ and $R_5'$ can each represent a hydrogen atom and an alkyl or aryl group, and $R_6$ and $R_7$ can each represent a hydrogen atom and an alkyl, substituted or nonsubstituted aryl or aralkyl group), and (h) at least one kind of stabilizer selected from noble metal complexes, organic oxidants and organic acids, and a recording element using the same.

48 Claims, 3 Drawing Figures

PHOTO-SENSITIVE AND HEAT-SENSITIVE COMPOSITION AND RECORDING ELEMENT USING SAME

BACKGROUND OF THE INVENTION

1. Field of the Invention

This invention relates to a photo-sensitive and heat-sensitive composition which is devised to be fixed when irradiated with visible light and heated and generate color when irradiated with ultraviolet ray to thereby produce a high quality image directly by dry method, and a recording element comprising a support and a layer made of said composition superposed on said support.

2. Description of the Prior Art

A considerably large number of image-forming recording elements have been widely utilized or proposed up to now. As their typical instances there can be enumerated, for instance, diazo copying materials using alkali media as developers, photographic films using silver salts, etc. However, the above mentioned image-forming recording elements are defective in that developers and fixers must be used in order to obtain an image in practice.

As an attempt to eliminate the foregoing defects, accordingly, public attention has been attracted to dry photochemical photo-sensitive compositions and recording elements capable of forming images only with light as disclosed in Japanese Patent Publication Nos. 19161/1968, 40150/1970, 17855/1972, Japanese Laid Open Patent Application No. 12879/1972, etc. For instance, the photo-sensitive composition as disclosed in Japanese Patent Publication No. 19161/1968 comprises (a) photooxidant such as hexaarylbiimidazole, tetraarylhydrazine or the like, (b) a color-generator such as leuco-pigment, hydrazone or the like and (c) a binary system redox couple comprising an oxidant component such as quinone, ketone or the like and a reductant component such as alcohol, ester or the like or a one component system redox couple such as 1,4-bis (2-methoxyethyl) anthraquinone or the like. This photo-sensitive composition generates color when being subjected to light of specific wavelength such as ultraviolet ray, and its originally generated color is deactivated permanently, that is, fixed by light of different wavelength such as visible light. In this instance, the color generating reaction is performed by the action of photooxidant and color-generator and the fixing reaction is performed by the action of said redox couple. Accordingly, the use of the photo-sensitive composition of this type can obtain both positive image and negative image by selecting the sequence of irradiation of ultraviolet ray and visible light, but said photo-sensitive composition is defective in that the fixing sensitivity is extremely low as compared with the color generating sensitivity.

Japanese Patent Publication Nos. 139722/1975, 139723/1975, 139724/1975, etc. disclose each an image-forming recording element comprising a support and a photo-sensitive and heat-sensitive layer superposed thereon. The photo-sensitive and heat-sensitive composition used herein is mainly composed of (a) a cobalt (III) complex and (b) a photoreductant such as quinone, diazonium salt, disulfide or the like. In the case of the composition of this sort there is formed an image in such a manner that the photoreductant generates a reducing agent when irradiated with visible light and this agent reduces and discolors the cobalt (III) complex when heated (at the same time the cobalt (III) complex generates a basic substance such as ammonia or the like). Moreover, Japanese Patent Publication No. 139724/1975 proposes to accelerate the reduction of the cobalt (III) complex as well as promote the developed color density by the addition of a chelating agent such as nitroso-arol, dithiooxyamide or the like. In this connection, it is to be noted that the use of such a chelating agent-containing photo-sensitive and heat-sensitive composition is surely advantageous in that a high sensitive image can be obtained as compared with diazo copying materials by the aid of the oxidation reduction reaction between the cobalt (III) complex and the photoreductant, but on the other hand is defective in the following points, namely, (1) since the coloration of the composition is effected by the action of the generated cobalt (III) chelate complex compound there can be obtained only a negative image, (2) the obtained image undergoes severe thermal fog (in the heating step, the periphery of the exposed area generates color, too) and the like.

SUMMARY OF THE INVENTION

This invention has been completed in order to eliminate the aforegoing drawbacks. In other words, the primary object of this invention is to provide a photo-sensitive and heat-sensitive composition capable of forming a high contrast as well as resolution image by widely enhancing the fixing sensititivy without deteriorating the color-forming sensitivity as well as improving the storability and a recording element using the said composition.

The secondary object of this invention is to provide a photosensitive and heat-sensitive composition which is capable of obtaining either a positive image or a negative image selectively and a recording element using the said composition.

The photo-sensitive and heat-sensitive composition according to this invention is consisted essentially of (a) a photooxidant, (b) a color-generator generating color when oxidized, (c) an acid promoting said color generation, (d) a cobalt (III) ammine and/or amine complex, (e) a photoreductant, (f) a hydrogen donator, (g) at least one kind of chelating agent selected from dioxime chelating agents having the general formula (I):

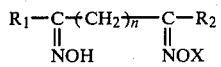

(I)

(wherein n is an integer of 0 to 3, and $R_1$ and $R_2$ can each represent an alkyl, aryl or aralkyl group) and diantipyrylmethane chelating agents having the general formula (II):

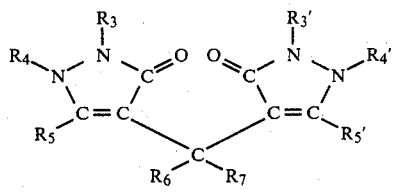

(II)

(wherein $R_3$, $R_4$, $R_5$, $R_3'$, $R_4'$, and $R_5'$ can each represent a hydrogen atom and an alkyl or aryl group, and $R_6$ and $R_7$ can each represent a hydrogen atom and an alkyl, substituted or nonsubstituted aryl or aralkyl group), and (h) at least one kind of stabilizer selected from noble metal complexes, organic oxidants and organic acids.

The photo-sensitive and heat-sensitive composition according to this invention produces a basic substance (ammonia or amine) by irradiation of visible light and heating. This basic substance is fixed on the composition and the same is subjected to ultraviolet ray irradiation for generating color, whereby these is formed an image. The composition according to this invention includes components constituting the fixing system and those constituting the color-generating system. The components, (e) a photoreductant, (f) a hydrogen donator, (d) a cobalt (III) ammine and/or amine complex (which will be referred to as cobalt (III) complex hereinafter) and (g) at least one kind of chelating agent selected from dioxime chelating agents and diantipyrylmethane chelating agents, constitute the fixing system. The components, (a) a photooxidant, (b) a color-generator generating color when oxidized and (c) an acid promoting said color generation, constitute the color-generating system. And, the component, (h) a stabilizer, takes part in the storability of the composition according to this invention. In this connection, it is to be noted that the photo-sensitive and heat-sensitive composition according to this invention may further include such components as a binder, a plasticizer, a filler and the like.

As the cobalt (III) complexes (component d) there can be employed any substances which produce basic substances such as ammonia and the like when thermally reduced. As a matter of course, however, said substances must be stable at normal temperature. The typical examples of the (d) cobalt (III) complexes suitably used in this invention can be enumerated as follows:

(1) hexa-ammine cobalt (III) perchlorate
(2) hexa-ammine cobalt (III) acetate
(3) hexa-ammine cobalt (III) thiocyanate
(4) hexa-ammine cobalt (III) trifluoroacetate
(5) hexa-ammine cobalt (III) benzylate
(6) chloropenta-ammine cobalt (III) bromide
(7) chloropenta-ammine cobalt (III) perchlorate
(8) bromopenta-ammine cobalt (III) bromide
(9) bromopenta-ammine cobalt (III) perchlorate
(10) aquopenta-ammine cobalt (III) nitrate
(11) aquopenta-ammine cobalt (III) perchlorate
(12) bis(ethylenediamine)di-ammine cobalt (III) perchlorate
(13) bis(ethylenediamine)diazido cobalt (III) perchlorate
(14) bis(ethylenediamine)diacetate cobalt (III) chloride
(15) bis(ethylenediamine)diacetate cobalt (III) trifluoroacetate
(16) triethylenetriamine dichloro cobalt (III) trifluoroacetate
(17) bis(methylamine)tetraammine cobalt (III) hexafluorophosphate
(18) aquopenta(methylamine) cobalt (III) nitrate
(19) chloropenta(ethylamine) cobalt (III) chloride
(20) chloropenta(ethylamine) cobalt (III) perfluorobutanoate
(21) trinitrotris-ammine cobalt (III)
(22) trinitrotris(methylamine) cobalt (III)
(23) tris(ethylenediamine) cobalt (III) acetate
(24) tris(ethylenediamine) cobalt (III) perchlorate
(25) tris(1,3-propanediamine) cobalt (III) trifluoroacetate
(26) N,N'-ethylenebis(solicylideneimine)bisammine cobalt (III) bromide
(27) N,N'-ethylenebis(salicylideneimine)bisammine cobalt (III) perchlorate
(28) $\mu$-superoxodeca-ammine dicobalt (III) perchlorate
(29) sodium dichloro ethylenediaminediacetate cobalt (III)
(30) penta-ammine carbonate cobalt (III) nitrate
(31) penta-ammine carbonate cobalt (III) perchlorate
(32) trans[bis(ethylenediamine)chlorothiocyanato cobalt (III)]sulfite
(33) trans[bis(ethylenediamine)chlorothiocyanato cobalt (III)]perchlorate
(34) trans[bis(ethylenediamine)diazido cobalt (III)]chloride
(35) trans[bis(ethylenediamine)diazido cobalt (III)]thiocyanate
(36) cis[ethylenediamine diazido cobalt (III)]trifluoroacetate
(37) tris (ethylenediamine) cobalt (III) chloride
(38) tris(ethylenediamine) cobalt (III) benzylate
(39) trans[bis(ethylenediamine)dichloro cobalt (III)]chloride
(40) trans[bis(ethylenediamine)dichloro cobalt (III)]perchlorate
(41) bis(ethylenediamine)dithiocyanato cobalt (III) fluoride
(42) bis(ethylenediamine)dithiocyanato cobalt (III) perfluorobenzoate
(43) triethylenetetraaminedinitro cobalt (III) iodate
(44) triethylenetetraaminedinitro cobalt (III) dichloroacetate
(45) tris (ethylenediamine) cobalt (III) 2-pyridylcarboxylate, and
(46) tris(ethylenediamine) cobalt (III) salicylate The (e) photoreductant used in the present invention is one which deprives hydrogen from the hydrogen donator when irradiated with visible light and is converted into a reducing substance and which is capable of reducing the cobalt (III) complex instantaneously when heated. As the typical examples thereof can be enumerated quinone, disulfide, diazo anthrone, diazonium salt, diazo phenanthrone, aromatic azide, acyloin, aromatic ketone, aromatic carbazide, aromatic diazo sulfonate, etc. Among them, the quinone is most preferable.

The quinone can be divided into an external hydrogen source type quinone which produces a reducing agent in the manner of drawing its hydrogen source (active hydrogen atom) out of another compound (hydrogen donator) and an internal hydrogen source type quinone which itself includes its own hydrogen source. The internal hydrogen source type quinone can itself exhibit a photoreducing property with ease but with little efficiency. Therefore, it is preferable that it should be used in combination with the hydrogen donator.

As the concrete examples of the aforesaid external hydrogen source type quinone there can be enumerated the following substances:

(1) 2,5-dimethyl-1,4-benzoquinone,
(2) 2,6-dimethyl-1,4-benzoquinone,
(3) duroquinone,
(4) 2-(1'-formyl-1-methylethyl)-5-1,4-benzoquinone,
(5) 2-methyl-1,4-benzoquinone,
(6) 2-phenyl-1,4-benzoquinone,
(7) 2,5-dimethyl-6-(1-formylethyl)-1,4-benzoquinone,
(8) 2-(2-cyclohexanoyl)-3,6-dimethyl-1,4-benzoquinone,
(9) 1,4-napthoquinone,
(10) 2-methyl-1,4-naphthoquinone,

(11) 2,3-dimethyl-1,4-naphthoquinone,
(12) 2,3-dichloro-1,4-naphthoquinone,
(13) 2-thiomethyl-1,4-naphthoquinone,
(14) 2-(1-formyl-2-propyl)-1,4-naphthoquinone,
(15) 2-(2-benzoylethyl)-1,4-naphthoquinone,
(16) 9,10-phenanthrenequinone,
(17) 2-isobutyl-9,10-anthraquinone,
(18) 2-methyl-1,4-anthraquinone,
(19) 2-methyl-9,10-anthraquinone,
(20) 1,8-pyrenquinone, and
(21) 1,6-pyrenquinone On the other hand, as the concrete examples of the aforesaid internal hydrogen source type quinone there can be enumerated the following substances:

(1) 5,8-dihydro-1,4-naphthoquinone,
(2) 5,8-dihydro-2,5,8-trimethyl-1,4-naphthoquinone,
(3) 2,5-bis(dimethylamino)-1,4-benzoquinone,
(4) 2,5-dimethyl-3,6-bis(dimethylamino)-1,4-benzoquinone,
(5) 2,5-dimethyl-3,6-bispyrolidino-1,4-benzoquinone,
(6) 2-ethoxy-5-methyl-1,4-benzoquinone,
(7) 2,6-dimethoxy-1,4-benzoquinone,
(8) 2,5-dimethoxy-1,4-benzoquinone,
(9) 2,6-diethoxy-1,4-benzoquinone,
(10) 2,5-diethoxy-1,4-benzoquinone,
(11) 2,5-bis(2-methoxyethoxy)-1,4-benzoquinone,
(12) 2,5-bis(β-phenoxyethyoxy)-1,4-benzoquinone,
(13) 2,5-diphenethoxy-1,4-benzoquinone,
(14) 2,5-di-n-propoxy-1,4-benzoquinone,
(15) 2,5-di-isopropoxy-1,4-benzoquinone,
(16) 2,5-di-n-butoxy-1,4-benzoquinone,
(17) 2,5-di-sec-butoxy-1,4-benzoquinone,
(18) 1,1'-bis(5methyl-1,4-benzoquinone-2-yl)diethyl ether,
(19) 2-methyl-5-morpholinomethyl-1,4-benzoquinone,
(20) 2,3,5-trimethyl-6-morpholinomethyl-1,4-benzoquinone,
(21) 2,5-bis(morpholinomethyl)-1,4-benzoquinone,
(22) 2-hydroxymethyl-3,5,6-trimethyl-1,4-benzoquinone,
(23) 2-(1-hydroxyethyl)-5methyl-1,4-benzoquinone,
(24) 2-(1-hydroxy-n-propyl)-5-methyl-1,4-benzoquinone,
(25) 2-(1-hydroxy-2-methyl-n-propyl)-5methyl-1,4-benzoquinone,
(26) 2-(1,1-dimethyl-2-hydroxyethyl-5-methyl-1,4-benzoquinone,
(27) 2-(1-acetoxyethyl)-5-methyl-1,4-benzoquinone,
(28) 2-(1methoxyethyl)-5methyl-1,4-benzoquinone,
(29) 2-(2-hydroxyethyl)-3,5,6-trimethyl-1,4-benzoquinone,
(30) 2-ethoxy-5-phenyl-1,4-benzoquinone,
(31) 2-isopropoxy-5-phenyl-1,4-benzoquinone,
(32) 1,4-dihydro-1,4-dimethyl-9,10-anthraquinone,
(33) 2-dimethylamino-1,4-naphthoquinone,
(34) 2-methoxy-1,4-naphthoquinone,
(35) 2-benzolyloxy-1,4-naphthoquinone,
(36) 2-methoxy-3-chloro-1,4-naphthoquinone,
(37) 2,3-dimethoxyl-1,4-naphthoquinone,
(38) 2,3-diethoxy-1,4-naphthoquinone,
(39) 2-ethoxy-1,4-naphthoquinone,
(40) 2-phenethoxy-1,4-naphthoquinone,
(41) 2-(2-methoxyethoxy)-1,4-naphthoquinone,
(42) 2-(2-ethoxyethoxy)-1,4-naphthoquinone,
(43) 2-(2-phenoxy)ethoxy-1,4-naphthoquinone,
(44) 2-ethoxy-5methoxy-1,4-naphthoquinone,
(45) 2-ethoxy-6-methoxy-1,4-naphthoquinone,
(46) 2-ethoxy-7-methoxy-1,4-naphthoquinone,
(47) 2-n-propoxy-1,4-naphthoquine,
(48) 2-(3-hydroxypropoxy)-1,4-naphthoquinone,
(49) 2-isopropoxy-1,4-naphthoquinone,
(50) 7-methoxy-2-isopropoxy-1,4-naphthoquinone,
(51) 2-n-butoxy-1,4-naphthoquinone,
(52) 2-sec-butoxy-1,4-naphthoquinone,
(53) 2-n-pentoxy-1,4-naphthoquinone,
(54) 2-n-hexoxy-1,4-naphthoquinone,
(55) 2-n-heptoxy-1,4-naphthoquinone,
(56) 2-acetoxymethyl-3-methyl-1,4-naphthoquinone,
(57) 2-methoxymethyl-3methyl-1,4naphthoquinone,
(58) 2-(β-acetoxyethyl)-1,4-naphthoquinone,
(59) 2-N,N'-bis(cyanomethyl)aminomethyl-3-methyl-1,4-naphthoquinone,
(60) 2-methyl-3-morpholinomethyl-1,4-naphthoquinone,
(61) 2-hydroxymethyl-1,4-naphthoquinone,
(62) 2-hydroxymethyl-3-methyl-1,4-naphthoquinone,
(63) 2-(1-hydroxyethyl)-1,4-naphthoquinone,
(64) 2-(2-hydroxyethyl)-1,4-naphthoquinone,
(65) 2-(1,1-dimethyl-2-hydroxyethyl)-1,4-naphthoquinone,
(66) 2-bromo-3-isopropoxy-1,4-naphthoquinone,
(67) 2-ethoxy-3methyl-1,4-naphthoquinone,
(68) 2-chloro-3-piperidino-1,4-naphthoquinone,
(69) 2-morpholino-1,4-naphthoquinone,
(70) 2,3-dipiperidino-1,4-naphthoquinone,
(71) 2-benzyloamino-3-chloro-1,4-naphthoquinone,
(72) 2-methyloxycarbonylmethoxy-1,4-naphthoquinone,
(73) 2-(N-ethyl-N-benzylamino)-3-chloro-1,4-naphthoquinone,
(74) 2-morpholino-3-chloro-1,4-naphthoquinone,
(75) 2-piperidino-3-chloro-1,4-naphthoquinone,
(76) 2-diethylamino-3-chloro-1,4-naphthoquinone,
(77) 2-diethylamino-1,4-naphthoquinone,
(78) 2-piperidino-1,4-naphthoquinone,
(79) 2-(2-hexyloxy)-1,4-naphthoquinone,
(80) 2-neo-pentyloxy-1,4-naphthoquinone,
(81) 2-(2-n-pentyloxy)-1,4-naphthoquinone,
(82) 2-(3-methyl-n-butoxy)-1,4-naphthoquinone,
(83) 2-(6-hydroxy-n-hexoxy)-1,4-naphthoquinone,
(84) 2-methoxy-3-chloro-1,4-naphthoquinone,
(85) 2-ethoxy-3chloro-1,4-naphthoquinone,
(86) 2-di(phenyl)methoxy-1,4-naphthoquinone,
(87) 2-(2-hydroxyethoxy)-3-chloro-1,4-naphthoquinone,
(88) 2-methyl-3-(1-hydroxymethyl)ethyl-1,4-naphthoquinone,
(89) 2-azetidino-3-chloro,-1,4-naphthoquinone,
(90) 2-(2-hydroxyethyl)-3-bromo-1,4-naphthoquinone,
(91) 2,3-dimorpholino-1,4-naphthoquinone,
(92) 2-ethylamino-3-piperidino-1,4-naphthoquinone,
(93) 2-ethoxyethyl-1,4-naphthoquinone, and
(94) 2-phenoxymethyl-1,4-naphthoquinone.

The hydrogen donators (f) used suitably in the present invention, when exposed to light, are adapted to supply active hydrogen atoms to photoreductants for converting the latter into reducing substances. The concrete examples thereof are enumerated as follows. The other known useful hydrogen donators are described in for instance U.S. Pat. No. 3,383,212 Specification.

(1) polyethylene glycol,
(2) phenyl-1,2-ethanediol,
(3) nitrotriacetonitrile,
(4) triethylnitrilotriacetate,
(5) polyvinyl butyral, (6) polyvinyl acetal,
(7) 1,4-benzenedimethanol,
(8) methyl cellulose,
(9) cellulose acetate butyrate,
(10) 2,2-bis(hydroxymethyl)propionic acid,
(11) 1,3-bis(hydroxymethyl)urea,
(12) 4-nitrobenzyl alcohol,
(13) 4-methoxybenzyl alcohol,
(14) 2,4-dimethoxybenzyl alcohol,
(15) 3,4-dichlorophenyl glycol,
(16) N-(hydroxymethyl)benzamide,
(17) N-(hydroxymethyl)phthalimide,
(18) 5-(hydroxymethyl)-uracil hemihydrate,
(19) nitrilotriacetic acid,
(20) 2,2',2''-triethylnitrilotripropionate,
(21) 2,2',2''-nitrilotriacetophenone,
(22) polyvinyl acetate,
(23) polyvinyl alcohol,
(24) ethyl cellulose,
(25) carboxymethyl cellulose,
(26) polyvinyl formal,
(27) triethanolamine triacetate,
(28) triethanolamine tripropionate,
(29) triethanolamine tributyrate, and
(30) triethanolamine trivalerate.

In addition thereto there can be used

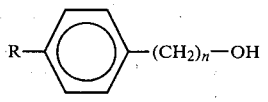

type alcohols such as benzyl alcohol, phenethyl alcohol, etc.

The hydrogen donators suitably used in the present invention actually achieve plural functions. For instance, the polymers of the above enumerated hydrogen donators also function as binders, and particularly the substances such as polyethylene glycol and alcohol also function as color generating assistants in the manner of enhancing the fluidity of the respective elements of the composition.

The chelating agent (g), which comprises a conjugated $\pi$ bond system adapted to form a bidenate chelate in combination with cobalt (III), is a substance capable of promoting the reduction of cobalt (III) complexes, but is not such a substance as usual nitroso-arol or dithiooxyamide which is usable as one component of the color-generating system for the purpose of forming a chelate capable of displaying a high developed color density. In other words, the dioxime chelating agents or diantipyrilmethane chelating agents according to this invention is a substance which is incorporated in the amplifying mechanism of the fixing system for promoting its fixing sensitivity. In this connection, it is to be noted that naturally this chelating agent does not function so as to impede the color generating effect to be produced by the color-generating system but rather contributes to the suppression of coloration of the background area by forming a chelating compound adapted to exhibit an extremely low developed color density in the visible region.

Concrete examples of the dioxime chelating agents can be enumerated as follows:
(1) glyoxime,
(2) dimethylglyoxime,
(3) benzyldioxime,
(4) diethylglyoxime,
(5) acetylacetonedioxime,
(6) cyclohexane-1,2-dionedioxime,
(7) 2-furyldioxime,
(8) hexane-2,5-dionedioxime,
(9) cyclopentane-1,2-dionedioxime, and
(10) heptane-2,6-dionedioxime.

And, concrete examples of the diantipyrilmethane chelating agents can be enumerated as follows:
(1) diantipyrilmethane,
(2) 1,1-diantipyrilethane,
(3) 1,1-diantipyrilbutane,
(4) $\alpha,\alpha$-diantipyriltoluene,
(5) 1,1-diantipyril-3-methylbutane,
(6) 1,1-diantipyrilheptane,
(7) 3,3-diantipyril-1-phenylpropane,
(8) $\alpha,\alpha$-diantipyril-3,4-dimethoxytoluene,
(9) diantipyril-O-hydroxyphenylmethane,
(10) 3,3-diantipyril-3-phenylpropane,
(11) $\alpha,\alpha$-diantipyril-4-diethylaminotoluene,
(12) diantipyril-p-nitrophenylmethane, and
(13) triantipyrilmethane.

The photooxidant (a) used in this invention is a compound adapted to produce an oxidizing substance by irradiation of ultraviolet ray and oxidize a color generator with the thus produced oxidizing substance for color generating purposes. The photooxidants suitably used in this invention include hexaarylbiimidazoles and halogen compounds.

Typical examples of said hexaarylbiimidazoles are enumerated as follows:
2,2'-bis(p-methoxyphenyl)-4,4',5,5'-tetraphenylbiimidazole,
2,2'-bis(p-cyanophenyl)-4,4',5,5'-tetrakis(p-methoxyphenyl)biimidazole,
2,8'-bis(p-cyanophenyl)-4,4',5,5'-tetrakis(p-methoxyphenyl)biimidazole,
2,2'-bis(3,4,5-trimethylphenyl)-4,4',5,5'-tetrakis(p-methylthiophenyl)biimidazole,
2,2'-bis(O-methoxyphenyl)-4,4',5,5'-tetraphenylbiimidazole,
2,2'-bis(2,4-dichlorophenyl)-4,4',5,5'-tetrakis(p-methoxyphenyl)biimidazole,
2,2'-bis(O-bromophenyl)-4,4',5,5'-tetraphenylbiimidazole,
2,2'-bis(2,4-dimethoxyphenyl)-4,4'5,5'-tetraphenylbiimidazole,
2,2'-bis(O-chlorophenyl)-4,4',5,5'-tetraphenylbiimidazole,
2,2'-bis(O-chlorophenyl)-4,4',5,5'-tetrakis(m-methoxyphenyl)biimidazole,
2,2'-bis(O-chlorophenyl)-4,4'-bis(p-methoxyphenyl)-5,5'-diphenylbiimidazole, and
2,2'-bis(O-chloro-p-methoxyphenyl)-4,4',5,5'-tetraphenylbiimidazole.

And, typical examples of said halogen compounds are enumerated as follows:
carbon tetraiodide,
iodoform,
carbon tetrabromide,
1,2,3,4-tetrachlorobenzene,
1,2,3,4-tetrabromobutane, and
hexachloroethane.

Of the above enumerated photooxidants, the hexaarylbiimidazoles can be represented by the formula

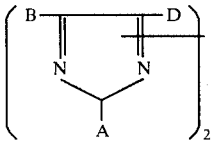

(wherein A, B and D are aryl groups. The B and D groups normally carry 0–3 substituents and the A group carries 0–4 substituents.) The aryl groups include one- and two-ring aryls such as phenyl, biphenyl, naphthyl, pyridyl, furyl, thienyl and the like. The substituents may be halogen, cyano, lower hydrocarbyl (including alkyl, halo alkyl, cyanoalkyl, hydroxyalkyl, aryl and the like), lower alkoxy, aryloxy, lower alkyl thio, arylthio, sulfo, alkylsulfonyl, nitro, lower alkylcarbonyl and the like. It is preferable that the alkyl groups are of 1–6 carbon atoms, while aryl groups are of 6–10 carbon atoms. And, preferable hexarylbiimidazoles include 2,2',4,4',5,5'-hexaphenylbiimidazole bearing chlorine, bromine, fluorine, $C_1$–$C_6$ alkoxy or $C_1$–$C_6$ alkyl group at the ortho-position of the 2- and 2'-phenyl rings. Among them, the 2,2'-bis(o-chlorophenyl)-4,4',5,5'-tetraphenylbiimidazole is most preferable.

The color-generator (b) is a substantially colorless compound which is designed to generate color when undergoing the oxidizing action of an oxidizing substance generated from the photooxidant. And, as a matter of course it is required to be stable against the airing under normal storing conditions while being incorporated in the composition. Such exemplary color-generators are enumerated as follows:

(A) Leuco dyes (a) Aminotriarylmethanes bis(4-amino-2-butylphenyl) (p-dimethylaminophenyl)methane,
bis(4-amino-2-chlorophenyl) (p-aminophenyl)methane,
bis(4-amino-3-chlorophenyl) (O-chlorophenyl)methane,
bis(4-amino-3-chlorophenyl)phenylmethane,
bis(4-amino-3,5-diethylphenyl) (O-chlorophenyl)methane,
bis(4-amino-3,5-diethylphenyl) (O-ethoxyphenyl)methane,
bis(4-amino-3,5-diethylphenyl) (p-methoxyphenyl)methane,
bis(4-amino-3,5-diethylphenyl)phenylmethane,
bis(4-amino-3-ethylphenyl) (O-chlorophenyl)methane,
bis(p-aminophenyl) (4-amino-m-tolyl)methane,
bis(p-aminophenyl) (O-chlorophenyl)methane,
bis(p-aminophenyl) (p-chlorophenyl)methane,
bis(p-aminophenyl) (2,4-dichlorophenyl)methane,
bis(p-aminophenyl) (2,5-dichlorophenyl)methane,
bis(p-aminophenyl) (2,6-dichlorophenyl)methane,
bis(4-amino-O-tolyl) (p-chlorophenyl)methane,
bis(4-amino-O-tolyl) (2,4-dichlorophenyl)methane,
bis(p-aminophenyl) (4-amino-m-tolyl)methane,
bis(4-benzylamino-2-cyanophenyl) (p-aminophenyl)methane,
bis(p-benzylethylaminophenyl) (p-chlorophenyl)methane,
bis(p-benzylethylaminophenyl) (p-diethylaminophenyl)methane,
bis(p-benzylethylaminophenyl) (p-dimethylaminophenyl)methane,
bis(4-benzylethylamino-O-tolyl) (p-methoxyphenyl)methane,
bis(p-benzylethylaminophenyl)phenylmethane,
bis(4-benzylethylamino-O-tolyl) (O-chlorophenyl)methane,
bis(4-benzylethylamino-O-tolyl) (p-diethylaminophenyl)methane,
bis(4-benzylethylamino-O-tolyl) (4-diethylamino-O-tolyl)methane,
bis(4-benzylethylamino-O-tolyl) (p-dimethylaminophenyl)methane,
bis[2-chloro-4-(2-diethylaminoethyl)ethylaminophenyl](O-chlorophenyl)methane,
bis[p-bis(2-cyanoethyl)aminophenyl]phenylmethane,
bis[p-(2-cyanoethyl)ethylamino-O-tolyl](p-diethylaminophenyl)methane,
bis[p-(2-cyanoethyl)methylaminophenyl](p-diethylaminophenyl)methane,
bis(p-dibutylaminophenyl)[p-(2-cyanoethyl)methylaminophenyl]methane,
bis(p-dibutylaminophenyl) (p-diethylaminophenyl)methane,
bis(4-dibutylamino-2-butoxyphenyl) (p-diethylaminophenyl)methane,
bis(4-diethylamino-2-fluorophenyl)-O-tolylmethane,
bis(p-diethylamino) (p-aminophenyl)methane,
bis(p-diethylaminophenyl) (4-amino-1-naphthyl)methane,
bis(p-diethylaminophenyl) (m-butyoxyphenyl)methane,
bis(p-diethylaminophenyl) (O-chlorophenyl)methane,
bis(p-diethylaminophenyl) (p-cyanophenyl)methane,
bis(p-diethylaminophenyl) (2,4-dichlorophenyl)methane,
bis(p-diethylaminophenyl) (4-diethylamino-1-naphthyl)methane,
bis(p-diethylaminophenyl) (p-dimethylaminophenyl)methane,
bis(p-diethylaminophenyl) (4-ethylamino-1-naphthyl)methane,
bis(p-diethylaminophenyl)-2-naphthylmethane,
bis(p-diethylaminophenyl) (p-nitrophenyl)methane,
bis(p-diethylaminophenyl)-2-pyridylmethane,
bis(p-diethylamino-m-tolyl) (p-diethylaminophenyl)methane,
bis(4-diethylamino-O-tolyl) (O-chlorophenyl)methane,
bis(4-diethylamino-O-tolyl) (p-diethylaminophenyl)methane,
bis(4-diethylamino-O-tolyl) (p-diphenylaminophenyl)methane,
bis(4-diethylamino-O-tolyl)phenylmethane,
bis(4-dimethylamino-2-bromophenyl)phenylmethane,
bis(p-dimethylaminophenyl) (4-amino-1-naphthyl)methane,
bis(p-dimethylaminophenyl) (p-butylaminophenyl)methane,
bis(p-dimethylaminophenyl) (p-sec-butylethylaminophenyl)methane,
bis(p-dimethylaminophenyl) (p-chlorophenyl)methane,
bis(p-dimethylaminophenyl) (p-diethylaminophenyl)methane,
bis(p-dimethylaminophenyl) (4-dimethylamino-1-naphthyl)methane,
bis(p-dimethylaminophenyl) (6-dimethylamino-m-tolyl)methane,
bis(p-dimethylaminophenyl) (4-diethylamino-O-tolyl)methane,
bis(p-dimethylaminophenyl) (4-ethylamino-1-naphthyl)methane, bis(p-dimethylaminophenyl) (p-hexyloxyphenyl)methane,
bis(p-dimethylaminophenyl) (p-methoxyphenyl)methane,
bis(p-dimethylaminophenyl) (5-methyl-2-pyridyl)methane,
bis(p-dimethylaminophenyl)-2-quinolylmethane,
bis(p-dimethylaminophenyl)-O-tolylmethane,
bis(p-dimethylaminophenyl) (1,3,3-trimethyl-2-indolinylidene methyl)methane,
bis(4-dimethylamino-O-tolyl) (p-aminophenyl)methane,
bis(4-dimethylamino-O-tolyl) (O-bromophenyl)methane,
bis(4-dimethylamino-O-tolyl) (O-cyanophenyl)methane,
bis(4-dimethylamino-O-tolyl) (O-fluorophenyl)methane,
bis(4-dimethylamino-O-tolyl)-1-naphthylmethane,
bis(4-dimethylamino-O-tolyl)phenylmethane,
bis(p-ethylaminophenyl) (O-chlorophenyl)methane,
bis(4-ethylamino-m-tolyl) (O-methoxyphenyl)methane,
bis(4-ethylamino-m-tolyl) (p-methoxyphenyl)methane,
bis(4-ethylamino-m-tolyl) (p-dimethylaminophenyl)methane,
bis(4-ethylamino-m-tolyl) (p-hydroxyphenyl)methane,
bis[4-ethyl(2-hydroxyethyl)amino-m-tolyl](p-diethylaminophenyl)methane,
bis[p-(2-hydroxyethyl)aminophenyl](O-chlorophenyl)methane,
bis[p-bis(2-hydroxyethyl)aminophenyl](4-diethylamino-O-tolyl)methane,
bis[p-(2-methoxyethyl)aminophenyl]phenylmethane,
bis(p-methylaminophenyl) (O-hydroxyphenyl)methane,
bis(p-propylaminophenyl) (m-bromophenyl)methane,
tris(4-amino-O-tolyl)methane,
tris(4-anilino-O-tolyl)methane,
tris(p-benzylaminophenyl)methane,
tris[4-bis(2-cyanoethyl)amino-O-tolyl]methane,
tris[p-(2-cyanoethyl)ethylaminophenyl]methane,
tris(p-dibutylaminophenyl)methane,
tris(p-di-n-butylaminophenyl)methane,
tris(4-diethylamino-2-chlorophenyl)methane,
tris(p-diethylaminophenyl)methane,
tris(4-diethylamino-O-tolyl)methane,
tris(p-dihexylamino-O-tolyl)methane,
tris(4-dimethylamino-O-tolyl)methane,
tris(p-hexylaminophenyl)methane,
tris[p-bis(2-hydroxyethyl)aminophenyl]methane,
tris(p-methylaminophenyl)methane,
tris(p-dioctadecylaminophenyl)methane,
tris(4-diethylamino-2-fluorophenyl)methane,
tris(4-dimethylamino-2-fluorophenyl)methane,
bis(2-bromo-4-diethylaminophenyl)phenylmethane,
bis(2-butoxy-4-diethylaminophenyl)phenylmethane,
bis(4-diethylamino-O-tolyl) (p-methoxyphenyl)methane,
bis(4-diethylamino-2-methoxyphenyl) (p-nitrophenyl)methane,
bis(4-diethylamino-1-naphthyl) (4-diethylamino-O-tolyl)methane,
bis(4-diethylamino-O-tolyl)-1-naphthylmethane,
bis(4-diethylamino-O-tolyl)phenylmethane,
tris(4-diethylamino-2-chlorophenyl)methane,
bis(4-dimethylamino-2,5-diethylphenyl)phenylmethane,
bis(4-dimethylamino-O-tolyl) (O-bromophenyl)methane,
bis(4-ethylbenzylamino-O-tolyl) (p-methoxyphenyl)methane,
tris(p-dioctylamino-O-tolyl)methane,
bis(4-diethylamino-O-tolyl)-4-methoxy-1-naphthylmethane,
bis(4-diethylamino-O-tolyl)-3,4,5-trimethoxyphenylmethane,
bis(4-diethylamino-O-tolyl)-p-hydroxyphenylmethane,
5-[bis(4-diethylamino-O-tolyl)methyl]-2,3-cresotic acid,
4-[bis(4-diethylamino-O-tolyl)methyl]phenol,
4-[bis(4-diethylamino-O-tolyl)methyl]acetanilide,
4-[bis(4-diethylamino-O-tolyl)methyl]phenylacetate,
4-[bis(4-diethylamino-O-tolyl)methyl]benzoic acid,
4-[bis(4-diethylamino-O-tolyl)methyl]diphenyl sulfone,
4-[bis(4-diethylamino-O-tolyl)methyl]phenylmethyl sulfone,
4-[bis(4-diethylamino-O-tolyl)methyl]methylsulfonanilide,
4-[bis(4-diethylamino-O-tolyl)methyl]-p-tolylsulfonanilide,
bis(4-diethylamino-O-tolyl)-p-nitrophenylmethane,
bis(4-diethylamino-O-tolyl) (2-diethylamino-4-methyl-5-thiazolyl)methane,
bis(4-diethylamino-O-tolyl) (2-diethylamino-5-methyl-6-benzoxazolyl)methane,
bis(4-diethylamino-O-tolyl) (2-diethylamino-5-methyl-6-benzothiozolyl)methane,
bis(4-diethylamino-O-tolyl) (1-ethyl-2-methyl-3-indolyl)methane,
bis(4-diethylamino-O-tolyl) (1-benzyl-2-methyl-3-indolyl)methane,
bis(4-diethylamino-O-tolyl) (1-ethyl-2-methyl-5-methoxy-3-indolyl)methane,
bis(1-O-xylyl-2-methyl-3-indolyl) (4-diethylamino-O-tolyl)methane,
bis(4-diethylamino-O-tolyl) (1-ethyl-5-indolinyl)methane,
bis(1-isobutyl-6-methyl-5-indolinyl) (4-diethylamino-O-tolyl)methane,
bis(4-diethylamino-O-tolyl) (8-methyl-9-julolidinyl)methane,
bis(4-diethylamino-2-acetamidophenyl) (4-diethylamino-O-tolyl)methane,
4-[bis(4-diethylamino-O-tolyl)methyl]-N-ethylacetanilide,
bis[4-(1-phenyl-2,3-dimethyl-5-pyrazolinyl)](4-diethylamino-O-tolyl)methane,
bis(4-diethylamino-O-tolyl) (7-diethylamino-4-methyl-3-coumarinyl)methane,
bis(4-diethylamino-O-tolyl) (4-acrylamidophenyl)methane,
bis(4-diethylamino-O-tolyl) (p-benzylthiophenyl)methane,
bis(4-diethylamino-O-tolyl) (4-isopropylthio-3-methylphenyl)methane,
bis(4-diethylamino-O-tolyl) (4-chlorobenzylthiophenyl)methane,
bis(4-diethylamino-O-tolyl) (2-furyl)methane,
bis(4-diethylamino-O-tolyl) (3,4-methylenedioxyphenyl)methane,
bis(4-diethylamino-O-tolyl) (3,4-dimethoxyphenyl)methane,
bis(4-diethylamino-O-tolyl) (3-methyl-2-thienyl)methane, and
bis(4-diethylamino-O-tolyl) (2,4-dimethoxyphenyl)methane.

In addition to the above enumerated aminotriarylmethanes there can be employed leucotriphenylmethane dyes bearing the following CI numbers:

| | | | | | |
|---|---|---|---|---|---|
| 42000B, | 42005, | 42010, | 42025, | 42030, | 42036, |
| 42035, | 42040, | 42500, | 42505, | 42510B, | 42515, |
| 42520, | 42555B, | 42556, | 42563B, | 42600, | 42605, |
| 42705, | 42760, | 42785, | 43500. | | |

(b) Aminoxanthenes 3-amino-6-dimethylamino-2-methyl-9-(O-chlorophenyl)xanthene,
3-amino-6-dimethylamino-2-methyl-9-phenylxanthene,
3,6-bis(diethylamino)-9-(O-chlorophenyl)xanthene,
3,6-bis(diethylamino)-9-hexylxanthene,
3,6-bis(diethylamino)-9-(O-methoxycarbonylphenyl)xanthene,
3,6-bis(diethylamino)-9-methylxanthene,
3,6-bis(diethylamino)-9-phenylxanthene,
3,6-bis(diethylamino)-9-O-tolylxanthene,
3,6-bis(dimethylamino)-9-(O-chlorophenyl)xanthene,
3,6-bis(dimethylamino)-9-ethylxanthene,
3,6-bis(dimethylamino)-9-(O-methoxycarbonylphenyl)xanthene, and
3,6-bis(dimethylamino)-9-methylxanthene.

In addition to the above enumerated aminoxanthenes there can be employed leucoxanthene dyes bearing the following CI numbers:

| | | | | | |
|---|---|---|---|---|---|
| 45000, | 45005, | 45010, | 45015, | 45050, | 45070, |
| 45090, | 45095, | 45100, | 45105, | 45150. | |

(c) Aminothioxanthenes 3,6-bis(diethylamino)-9-(O-ethoxycarbonylphenyl)thioxanthene,
3,6-bis(dimethylamino)-9-(O-methoxycarbonylphenyl)-thioxanthene,
3,6-bis(dimethylamino)thioxanthene, and
3,6-dianilino-9-(O-ethoxycarbonylphenyl)thioxanthene.

(d) Amino-9,10-dihydroacridines 3,6-bis(benzylamino)-9,10-dihydro-9-methylacridine,
3,6-bis(diethylamino)-9-hexyl-9,10-dihydroacridine,
3,6-bis(diethylamino)-9,10-dihydro-9-methylacridine,
3,6-bis(diethylamino)-9,10-dihydro-9-phenylacridine,
3,6-diamino-9-hexyl-9,10-dihydroacridine,
3,6-diamino-9,10-dihydro-9-methylacridine,
3,6-diamino-9,10-dihydro-9-phenylacridine,
3,6-bis(dimethylamino)-9-hexyl-9,10-dihydroacridine, and
3,6-bis(dimethylamino)-9,10-dihydro-9-methylacridine.

In addition thereto there can also be enumerated the leucoacridine dyes bearing CI numbers 46000, 46005B, 46010, 46015, 46020, 46025, 46030, 46035, 46040, 46055, 46060, 46065, 46070, 46075 and 46080.

(e) Aminophenoxazines 3,7-bis(diethylamino)phenoxazine,
9-dimethylamino-benzo[a]phenoxazine, and leucophenoxazine dyes bearing CI numbers 51000, 51180, 51185, 51190 and 51195 (for instance, 5-benzylamino-9-diethylamino-benzo[a]phenoxadine).

(f) Aminophenothiazines 3,7-bis(benzylamino)phenothiazine and leucophenothiazine dyes bearing CI numbers 52000, 52010, 52015, 52020, 52025, 52030, 52035 and 52050 {for instance, 3,7-bis(dimethylamino)-4-nitrophenothiazine; 3,7-bis[N-ethyl-N-(m-sulfobenzyl)amino]phenothiazine.-monosodium salt; and 3,7-diaminophenothiazine}.

(g) Aminodihydrophenazines 3,7-bis(benzylethylamino)-5,1-dihydro-5-phenylphenazine,
3,7-bis(diethylamino)-5-hexyl-5,10-dihydrophenazine,
3,7-bis(dihexylamino)-5,10-dihydrophenazine,
3,7-bis(dimethylamino)-5-(p-chlorophenyl)-5,10-dihydrophenazine,
3,7-diamino-5,10-dihydroxyphenazine,
3,7-diamino-5,10-dihydro-5-methylphenazine,
3,7-diamino-5-hexyl-5,10-dihydrophenazine,
3,7-diamino-5-(O-chlorophenyl)-5,10-dihydrophenazine,
3,7-bis(dimethylamino)-5,10-dihydrophenazine,
3,7-bis(dimethylamino)-5,10-dihydro-5-phenylphenazine,
3,7-bis(dimethylamino)-5,10-dihydro-5-methylphenazine, and in addition thereto can be employed leucophenazine dyes bearing CI numbers 50035, 50040, 50045, 50200, 50205, 50206, 50210, 50216, 50220, 50225, 50235 and 50240.

(h) Aminodiphenylmethanes 1,4-bis[bis-p-(diethylaminophenyl)methyl]piperazine,
bis(p-diethylaminophenyl)anilinomethane,
bis(p-diethylaminophenyl)-1-benzotriazolylmethane,
bis(p-diethylaminophenyl)-2-benzotriazolylmethane,
bis(p-diethylaminophenyl) (p-chloroanilino)methane,
bis(p-diethylaminophenyl) (2,4-dichloroanilino)methane,
bis(p-diethylaminophenyl) (methylamino)methane,
bis(p-diethylaminophenyl) (octadecylamino)methane,
bis(p-dimethylaminophenyl)aminomethane,
bis(p-dimethylaminophenyl)anilinomethane,
1,1-bis(dimethylaminophenyl)ethane,
1,1-bis(dimethylaminophenyl)heptane, and
bis(4-methylamino-m-tolyl)aminoethane.

(i) Leuco indoamines 4-amino-4'-dimethylaminodiphenylamine,
p-(p-dimethylaminoanilino)phenol, and leuco indoamine and indophenol dyes bearing CI numbers 49400, 49405, 49410 and 49700.

(j) Aminohydrocinnamic acids (cyanoethanes, leucomethines)

methyl 4-amino-$\alpha,\beta$-dicyanohydrocinnamate,
methyl 4-anilino-$\alpha,\beta$-dicyanohydrocinnamate,
methyl 4-(p-chloroanilino)-$\alpha,\beta$-dicyanohydrocinnamate,
$\alpha$-cyano-4-dimethylaminohydrocinnamamide,
methyl $\alpha$-cyano-4-dimethylaminohydrocinnamate,
methyl $\alpha,\beta$-dicyano-4-diethylaminohydrocinnamate,
$\alpha,\beta$-dicyano-4-dimethylaminohydrocinnamamide,
methyl $\alpha,\beta$-dicyano-4-dimethylaminohydrocinnamate,
$\alpha,\beta$-dicyano-4-dimethylaminohydrocinnamic acid,
hexyl $\alpha,\beta$-dicyano-4-dimethylaminohydrocinnamate,
methyl $\alpha,\beta$-dicyano-4-ethylaminohydrocinnamate,
methyl $\alpha,\beta$-dicyano-4-hexylaminohydrocinnamate,
methyl $\alpha,\beta$-dicyano-4-methylaminocinnamate,
p-(2,2-dicyanoethyl)-N,N-dimethylaniline,
4-methoxy-4'-(1,2,2-tricyanoethyl)azobenzene,
4-(1,2,2-tricyanoethyl)azobenzene,
p-(1,2,2-tricyanoethyl)-N,N-diethylaniline, and substituted hydrocinnamic acids such as leuco pigments comprising dyes bearing CI numbers 48000, 48001 and 48005.

(k) Hydrazines 1-(p-diethylaminophenyl)-2-(2-pyridyl)hydrazine,
1-(p-dimethylaminophenyl)-2-(2-pyridyl)hydrazine,
1-(3-methyl-2-benzothiazolyl)-2-(4-hydroxy-1-naphthyl)hydrazine,
1-(2-naphthyl)-2-phenylhydrazine,
1-p-nitrophenyl-2-phenylhydrazine, and
1-(1,3,3-trimethyl-2-indolinyl)-2-(3-N-phenylcarbamoyl-4-hydroxy-1-naphthyl)hydrazine.

(l) Leuco indigoid dyes

Leuco indigoid dyes bearing CI numbers 73000, 73015, 73025, 73030, 73035, 73040, 73045, 73050, 73055, 73060, 73065, 73070, 73085, 73090, 73110, 73300, 73305, 73310, 73315, 73320, 73325, 73335, 73340, 73345, 73350 and 73360 (for instance, 7,7-diamino-5,5'-dichloroleucothioindigo; 6,6'-dichloro-4-methylleucothioindigo; 7,7'-dimethylleucoindigo; 5,5'-disulfoleucoindigo disodium salt and 5,5',7,7'-tetrachloroleucoindigo.)

(m) Amino-2,3-dihydroanthraquinones 1,4-dianilino-2,3-dihydroanthraquinone; 1,4-bis(ethylamino)-2,3-dihydroanthraquinone and leuco dyes bearing CI numbers 61100, 61105, 61107, 61116, 61120, 61140, 61500, 61505, 61510, 61515, 61520, 61525, 61530, 61535, 61540, 61545, 61565 and 61650 [for instance, 1-amino-4-methoxyanilino-2,3-dihydroanthraquinone and 1-p-(2-hydroxyethylamino)anilino-4-methylamino-2,3-dihydroanthraquinone].

(n) Phenethylanilines

N-(2-cyanoethyl)-p-phenethylaniline,
N,N-diethyl-p-phenethylaniline,
N,N-dimethyl-p-[2-(1-naphthyl)ethyl]aniline,
N,N-dimethyl-p-[2-(4-nitro-1-napthyl)ethyl]aniline,
N,N-dimethyl-p-phenethylaniline,
N,N-dimethyl-p-[2-(4-methoxy-1-naphthyl)ethyl]aniline,
p-(p-methoxyphenyl)aniline,
p-[2-(1-naphthyl)ethyl]aniline,
p-(p-nitrophenethyl)aniline, and
p-phenethylaniline.

(B) Organic amines 4,4'-ethylenedianiline,
diphenylamine,
N,N-dimethylaniline,
4,4'-methylenedianiline,
triphenylamine, and
N,vinylcarbazole.

The acids (c) promoting the color generation are required as coloring assistants for enhancing the color generation of the color-generator. As exemplary examples of said acids there can be enumerated organic or inorganic acids such as maleic acid, p-toluene sulfonic acid, hydrochloric acid, hydrobromic acid, nitric acid, phosphoric acid, acetic acid, oxalic acid, etc., and Lewis' acids such as zinc chloride, zinc bromide, ferric chloride, etc.

It is needless to say that the acid should be used in the most suitable quantity. The use of it in a quantity deviating from the optimum range is apt to produce little or no color generation. The degree of color generation varies depending on the kind and quantity of the composition to be used therein. In the case of the color generator having the folowing formula, for instance, it is most suitable that 2 moles of paratoluene sulfonate should be added thereto and if it is added in a quantity such as zero mole or 6 moles or more the degree of color generation is low:

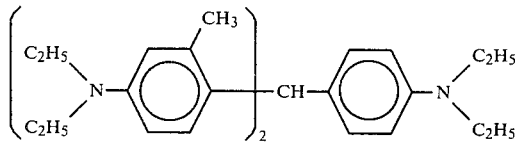

Referring to the suitable percentage of each component in the composition, the acid (c) is 1–10 moles, the photooxidant (a) is 0.1–10 moles, the cobalt (III) complex (d) is 0.1–10 moles, the photoreductant (e) is 0.1–10 moles and the chelating agent (g) is 0.1–10 moles respectively per mole of the color generator (b). The hydrogen donator (f) can be added from about 0.1 mole to an excess quantity per mole of the photoreductant.

The composition suitably used in this invention further includes at least one kind of stabilizer selected from noble metal complexes, organic oxidants and organic acids.

As the noble metal complexes there can be used complex compounds containing Ag, Au, Pd, Pt, Rh and Ir as constituting atoms. As the ligands used in this invention there can be enumerated halogen ions (chloride ion, bromide ion, iodide ion, fluoride ion, etc.), nitric ion, water, amines (ethylenediamine, trimethylenediamine, diethylenetriamine, triethylenetetramine, ethylenediaminetetraacetic acid ion, etc.), azido, ammonia, perchloride ion, thiocyanide ion, cyan ion, acetylacetone and its derivatives (trifluoroacetylacetone, benzoyltrifluoroacetone, furoyltrifluoroacetone, hexafluoroacetylacetone, pivaloylacetylacetone, etc.), triphenylphosphine, triphenylstibine and their derivatives. And, as their concrete examples there are enumerated $HAuCl_4$, $NaAuCl_4$, $K_2PdCl_4$, $(NH_4)_2PdCl_4$, $Na_2PdBr_4$, $Pd(aa)_2$, $RH(aa)_3$, $AgClO_4$, $HAu(CN)_4$, $NaAu(CN)_4$, $NaAu(S_2O_3)_2$, $[Pt(NH_3)_6]Cl_3$, $PtCL_2(N_2H_4)$, $[Pt(en)_2]Cl_2$, trans-$Pd(NH_2CH_2COO)_2$, $[Pt_2(NCS)_2Cl_2(P(C_3H_7)_3)_2]$, $[Pt(N(C_2H_3)_3)_4Cl_2]Cl_2$, $[Pd(en)_2]_2$, $[Pd(py)_2Cl_2]Cl_2$, trans-$Pd(NH_2CH_2COO)_2$, $[PdCl_2((CH_3)_3P)_2]$, $[Pd(NH_4)_4][Pd(SCN)_4]$, $[AuCl_2(py)_2]Cl$, $K[Au(CN)_2]$, $[Au(phen)Cl_2]Cl$, $[Au(dien)Cl]Cl_2$, $K_3[(Au(S_2O_3)_2]$, $[Rh(en)_3]Cl_3$, etc. Herein, aa represents acetylacetone, en represents ethylenediamine, phen represents 0-phenanthroline, dien represents diethylenetetramine, and py represents pyridine respectively. And, complexes are also usable wherein at least one ligand to be coordinate-bonded with noble metal atoms is dimethylformamide, tributyl phosphate, tributyl phosphorus oxide, etc.

The organic acids suitably used in this invention include ordinary ones such as acetic acid, oxalic acid, p-toluenesulfonic acid, tartaric acid, stearic acid, 10-oxystearic acid, myristic acid, palmitic acid, behenic acid, gallic acid, benzoic acid, salicylic acid, 1-oxy-2-naphthoic acid, succinic acid, 2-oxy-p-toluylic acid, m-oxybenzoic acid, p-oxybenzoic acid, 4-oxyphthalic acid, phloroglucinol carboxylic acid, dioxytartaric acid, 2,6-dioxytartaric acid, etc.

And, the organic oxidants suitably used in this invention, generally speaking, are identified as substances which are capable of attracting electrons, preferably compounds which are capable of dispersing molecules in a binder. As concrete examples thereof there can be enumerated the following compounds:

(1) Compounds having the following general formula (1)

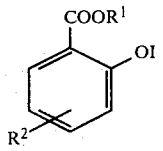

(1)

(wherein, $R^1$ can represent a hydrogen atom or $C_1$–$C_{12}$ straight chain or branched alkyl group, and $R^2$ can represent halogen or $C_1$–$C_4$ straight chain or branched alkyl group.)

As their exemplary examples there can be enumerated 0-iodosobenzoic acid, methyl 0-iodosobenzoate, octyl 0-iodosobenzoate, 2-iodoso-4-methylbenzoic acid, methyl 2-iodoso-4-ethylbenzoate, and so forth.

(2) Compounds having the following general formula (2)

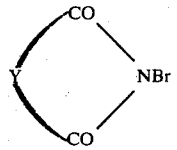

(2)

[wherein, Y can represent an atomic group capable of forming a ring in combination with -CO-NBr-CO-, for instance, such as

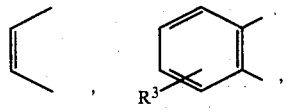

etc. ($R^3$ represents halogen or $C_1$–$C_4$ straight chain or branched alkyl groups.)]

As their exemplary examples there can be enumerated imido N-bromo-succinate, imido N-bromo phthalate and the like.

(3) Compounds having the following general formula (3)

$R^4$-CONHBr (3)

(wherein, $R^4$ can represent $C_1$–$C_{21}$ straight chain or branched alkyl groups)

As their exemplary examples there can be enumerated N-bromo-acetamide, amide N-bromolaurate, amide N-bromostearate and the like.

(4) Compounds having the following general formula (4)

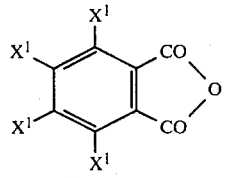

(4)

(wherein, $X^1$ can represent chlorine or bromine).

As their exemplary examples there can be enumerated tetrachlorophthalic anhydride, tetrabromophthalic anhydride and the like.

(5) Compounds having the following general formula (5)

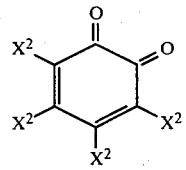

(5)

(wherein, $X^2$ can represent chlorine or bromine).

As their exemplary examples there can be enumerated 3,4,5,6-tetrachloro-1,2-benzoquinone and the like.

(6) Compounds having the following general formula (6)

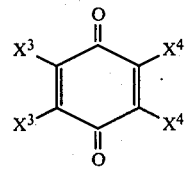

(6)

(wherein, $X^3$ can represent chlorine or bromine, and $X^4$ can represent chlorine, bromine or cyano groups).

As their exemplary examples there can be enumerated 2,3,5,6-tetrachloro-1,4-benzoquinone; 2,3,5,6-tetrabromo-1,4-benzoquinone; 2,3-dichloro-5,6-dicyano-1,4-benzoquinone; 2,3-dibromo-5,6-dicyano-1,4-benzoquinone and the like.

(7) Compounds having the following general formula (7)

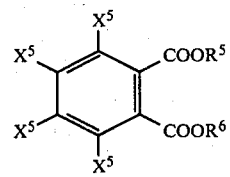

(7)

(wherein, $X^5$ can represent chlorine or bromine, and $R^5$ and $R^6$ can represent $C_1$–$C_{12}$ straight chain or branched alkyl groups).

As their exemplary examples there can be enumerated tetrachloro phthalic acid; monomethyl tetrachlorophthalate; diethyl tetrachlorophthalate; dioctyl tetrachlorophthalate and the like.

(8) Compounds having the following general formula (8)

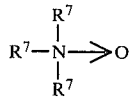

(8)

(wherein, $R^7$ can represent $C_1$–$C_{12}$ straight chain or branched alkyl groups).

As their exemplary examples there can be enumerated trimethylamine oxide; triethylamine oxide and the like.

(9) Compounds having the following general formula (9)

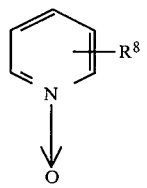

(9)

(wherein, $R^8$ can represent halogen or $C_1$–$C_4$ straight chain or branched alkyl groups).

As their exemplary examples there can be enumerated 2-chloropyridine-N-oxide; 2,4-dichloropyridine-N-oxide; 4-methylpyridine-N-oxide and the like.

(10) Compounds having the following general formula (10)

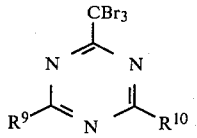

(10)

(wherein, $R^9$ and $R^{10}$ can each represent a hydrogen atom or tribromomethyl groups).

As their exemplary examples there can be enumerated 2-tribromomethyl-1,3,5-triazine; 2,4-bis(tribromomethyl)-1,3,5-triazine; 2,4,6-tris(tribromomethyl)-1,3,5-triazine and the like

(11) Compounds having the following general formula (11)

$$R^{11}—SO_2—CBr_3 \quad (11)$$

(wherein, $R^{11}$ can represent phenyl, tolyl, benzyl or $C_2$–$C_{12}$ straight chain or branched alkyl groups).

As their exemplary examples there can be enumerated tribromomethylsulfonylbenzene; 4-(tribromomethylsulfonyl)toluene and the like.

The quantities of the organic oxidant and the noble metal complex added suitably are each in the range of from 0.001 to 1 mole per mole of the photoreductant. The said quantities may be varied to a considerably large extent since the organic oxidant, depending on its kind, is apt to widely change the preserving effect of the composition. Generally speaking, preferably the said quantities are each in the range of from 0.1 to 0.5 mole or so. The use of them in excess quantities on the one hand surely increases the preserving stability of the composition, but on the other hand is apt to widely lower its fixing sensitivity. And, when used in too small quantities there can not be observed any good results to improve its preservability.

With reference to the quantity of the organic acid used suitably is in the range of from about 0.01 to 10 moles per mole of the photoreductant.

In this connection, it is to be noted that the concurrent use of the organic acid with the organic oxidant can bring about further improved results. The suitable quantities of said components added in this instance are each in the range of from about 0.05 to 5 mole of the photoreductant.

The binders suitably used in the present invention include a wide variety of natural or synthetic polymers. It is more preferable to use selectively from among them linear film-forming polymers, for instance, such as gelatin; celluloses, for instance, such as ethylcellulose, butylcellulose, cellulose acetate, cellulose triacetate, cellulose butyrate, etc.; vinyl polymers, for instance, such as polyvinyl acetate and polyvinylidene; polyvinylacetals, for instance, such as polyvinylbutyral, poly (vinylchloride-vinylacetate), polystyrene, polybutadiene, polyvinylpyrrolidone, and polymer or copolymer of esters of acrylic acid or methacrylic acid or both; and polyesters, for instance, such as poly(ethylene glycol-isophthalic acid-cyclohexylenebismethanol), poly(p-cyclohexanedicarbonic acid-2,2,4,4-tetramethylcyclobutane-1,3-diol). The condensate of epichlorohydrin and bisphenol is usefully employed as binder, too.

The plasticizer is employed in order to give a suitable flexibility and at the same time improve the color generating sensitivity. As the concrete examples thereof then can be enumerated polyethyleneglycols such as carbon wax and the like; substituted phenol-ethylene oxide addition products such as alkylphenoxypolyethylene ether of Igepal and the like; ethylene glycol; glycerine; pentaerythritol; and so forth.

The filler is employed effectively to give an improved writing ability to as well as remove a probable blocking inclination from the composition. And the filler includes titanium dioxide, silica, micro-alumina, powder glass and the like.

The recording element using the photo-sensitive and heat-sensitive composition according to the present invention can take the shapes as illustrated in FIGS. 1 to 3.

The recording element illustrated in FIG. 1 comprises a substrate 1 and a photo-sensitive and heat-sensitive layer 2 superposed on said substrate.

As the substrate there can be employed paper, plastic film and the like.

The photo-sensitive and heat-sensitive layer is consisted essentially of the photo-sensitive and heat-sensitive composition of the present invention. The quantity of the binder is preferable to be in the range of from 30 to 90% by weight of the total weight of the layer.

Preferably, the film thickness of the photo-sensitive and heat-sensitive layer is in the range of from 1 to 20 μm.

The recording element illustrated in FIG. 2 comprises a fixing layer 3 and a color generating layer 4 superposed on a substrate 1 in that order. In this instance, the fixing layer is consisted essentially of (d) a cobalt (III) complex, (e) a photoreductant, (f) a hydrogen donator, (g) a chelating agent and (h) a stabilizer, while the color generating layer is consisted essentially of (a) a photooxidant, (b) a color-generator generating color on oxidation and (c) an acid promoting said color generation.

The thickness of the fixing layer is in the range of from about 1 to 20 μm, and the thickness of the color generating layer is in the range of from about 1 to 20 μm, preferably from about 5 to 20 μm.

The recording element illustrated in FIG. 3 further comprises an intermediate layer 5 interposed between the fixing layer 3 and the color generating layer 4, wherein said intermediate layer is a resinous layer adapted to allow $NH_3$ gas, amines, etc. to permeate through it and its film thickness is in the range of from 1 to 10 μm, preferably from 3 to 5 μm.

The recording element according to the present invention may be actually prepared in the manner of coating a substrate, for instance, such as paper and the like with solutions obtained by dissolving or dispersing the components required for the preparation of respective layers in succession and then drying, thereby forming the respective layers. In this instance, coating may be made in accordance with usual means, for instance, such as doctor blade, wire bar and the like.

The solvents used in this case include amides such as formamide, dimethylformamide, dimethylacetoamide, hexaneamide, etc.; alcohols such as methanol, ethanol, 1-propanol, 2-propanol, butanol, ethylene glycol, polyethylene glycol, etc. and esters such as ethyl acetate, ethyl benzoate, etc.; aromatic compounds such as benzene, 0-dichlorobenzene, toluene; etc.; ketones such as acetone, methylethyl ketone, 3-pentanone, etc.; chlorinated hydrocarbons such as methylene chloride, chloroform, 1,1,2-trichloroethane; 1,1,2,2-tetrachloroethane, 1,1,2-trichloroethylene, etc.; dimethylsulfoxide; pyridine; tetrahydrofuran; dioxane; dicyanocyclobutane; 1-methyl-2-oxohexamethyleneimine, etc. In addition, water may be used herein if circumstances require.

In the preparation of the respective layers by the coating procedure as outlined above, when the solution containing the components required for the formation of the color generating layer is coated directly onto the fixing layer, it is apt to cause the diffusion and transfer of components between both layers with undesirable results. This will be detailed below. For instance, the following cases are liable to take place that when a large quantity of quinone has diffused from the fixing layer into the color generating layer, the composition most suitable for the color generating layer changes, thereby lowering the color generating concentration and that when a large quantity of acid has diffused from the color generating layer into the fixing layer the generating of the reducing agent and the basic substance is reduced, thereby lowering the sensitivity. In order to eliminate aforesaid undesirable results, there is provided the intermediate layer which is made of resin, preferably a water soluble resin or an emulsion-forming resin. Water is usable as the solvent or dispersion medium since it is serviceable for the purpose of further preventing the diffusion to be caused at the time when the aforesaid coating is effected. When a solvent other than water is employed, it is likely to happen that the components contained in the fixing layer dissolve out at the time when forming the intermediate layer by coating method and the same is likely to happen also at the time when coating the color generating layer, whereby the components contained in the fixing layer permeate into the color generating layer.

The water soluble resin suitably used herein includes polyvinyl alcohol, carboxymethyl cellulose, carboxyethyl cellulose, ethyl cellulose, methyl cellulose, polyvinyl pyrrolidone, sodium alginate, polystyrene sulfonic acid, sodium polystyrene sulfonate, polyacrylic acid, sodium polyacrylate, gelatine, soluble starch, casein and the like.

The emulsion-forming resin is one to be obtained in the form of emulsion and includes vinyl acetate resins, acryl resins, vinylidene chloride resins, SBR resins and the like. And the emulsion-forming resin can be obtained in the form of polyvinyl acetate emulsion (Polysol S series available from Showa Kobunsi K. K.), polymethyl acrylate emulsion (Primal B-5 available from Nihon Acryl Kagaku K. K.), polyvinylidene chloride emulsion (Diofan 190-Davailable from Yuka, Badische-Anin-&-Soda-Fabrik AG), vinyl acetate~ethylene copolymer emulsion (Denka FVA Tex #50 available from Denki Kagaku Kogyo K. K.), vinyl acetate~acrylic acid copolymer emulsion (Nicasole CL-244 available from Nihon Carbide Kogyo K. K.), styrene~methacrylic acid~methyl~butadiene copolymer emulsion (Polylack SL-204 available from Mitsui Toatsu Kagaku K. K.) and the like.

Next, the image-forming method applied to the recording element according to the present invention will be explained hereinafter. The recording element according to the present invention permits to selectively obtain a positive image or a negative image by suitably combining the steps of visible light irradiation, heating and ultraviolet ray irradiation.

First, the case of obtaining a positive image will be explained with reference to the recording element illustrated in FIG. 1. When the recording element is subjected to visible light irradiation through an original, the visible light does not reach the portion corresponding to the image area of said original, whereby said portion constitutes a non-exposed area and on the other hand the portion corresponding to the non-image area of the original constitutes an exposed area. Secondly, when the recording element is heated to a temperature ranging from 80° to 150° C., reaction takes place between the components constituting the fixing system of the exposed area for irreversibly inactivating or fixing this portion. This mechanism is analyzed as follows:

The photoreductant (e) present in the exposed area absorbs the visible light and draws the hydrogen from the coexisting hydrogen donator thereby to become a reducing substance. Successively, when this imagewise exposed recording element is heated to a temperature ranging from 80° to 150° C., said reducing substance acts to reduce the cobalt (III) complex (d), thereby producing an unstable cobalt (II) complex. This cobalt (II) complex, due to its unstableness, immediately decomposes into a cobalt (II) atom and a basic substance (ammonia) and at the same time this cobalt (II) atom cooperates with the chelating agent (g) to form a chelate comprising a bidentate ligand. And, this cobalt (II) chelate acts to reduce the remaining cobalt (III) complex (d) (that is, a basic substance is produced), and it is itself converted into a stable cobalt (III) chelate.

The final cobalt (III) chelate is thus formed. This reaction once it has started, continues until the chelating agent (g) or the cobalt (III) complex has been consumed completely in the exposed area. The thus produced basic substance acts to inactivate the color generating ability of the color generating system components of the exposed area. The recording element according to the present invention, as seen from the above-mentioned, can exhibit a very high fixing sensitivity by the concurrent use of the cobalt (III) complex (d) and the chelating agent (g).

Furthermore, the recording element according to the present invention does not employ, as usual, a chelating agent such as nitroso-arol, dithiooxyamide or the like which is used as one component of the color generating system for the purpose of producing a chelate having a high color generating concentration, but does employ, as a chelating agent, a dioxime chelating agent, a diantipyrylmethane chelating agent or the like which, when coordinate-bonded with cobalt, is capable of producing a chelate which displays little absorption over the visible region, whereby the exposed area is freed from coloration. Since this area becomes the background area of a recorded matter, it is natural that the recording element of the present invention permits to obtain an image having a low background area density and a high contrast.

Still further, it is to be noted that as the substances to deteriorate the contrast of an image to be obtained there can be considered polynuclear quinones (for instance, yellow in case where the photoreductant to be used is 9,10-phenanthrenequinone) and so forth, but the decomposition and decoloration thereof can be attained in the manner of leaving them stand under a fluorescent light after the image formation is completed.

Next, the thus fixed recording element is subjected to overall irradiation of ultraviolet ray. Since the visible light non-exposed area has not been influenced by the basic substance, the photooxidant (a) present in this portion absorbs the ultraviolet ray and becomes an oxidizing substance. The color generator (b) adapted to generate color on oxidation is oxidized by the action of said oxidizing substance, and cooperates with the acid promoting the color generation (c) to form a salt for generating color, whereby there is formed a positive image corresponding to the image area of the original. On the other hand, the visible light exposed area has already been fixed and so does in no way generate color. In other words, the acid promoting the color generation (c) has been neutralized by the basic substance or the photooxidant (a) has been trapped by the basic substance.

Then, explanation will be made on the case of obtaining a negative image by means of the recording element of the present invention. The same color generating principle is applicable to this case only with the exception that the sequence of color generating and fixing operations is reversed. In other words, a negative image can be obtained by the steps of first irradiating ultraviolet ray on the recording element through the original to thereby permit the exposed area corresponding to the non-image area of the original to generate color, then subjecting the same to overall irradiation of visible light and thereafter heating it for fixing purposes.

The above explanation was made with reference to the recording element illustrated in FIG. 1. However, it is to be noted that an image can also be obtained through the same procedure as mentioned above in the case of utilizing the recording element as illustrated in FIG. 2 or 3. In these cases, the basic substance generated in the fixing layer transfers through the intermediate layer into the color generating layer, thereby selectively inactivating the color generating ability of the visible light exposed area.

An image can be obtained in the above mentioned manner, but the conventional recording element is defective in that it lacks the ability to preserve the obtained image as it is for a long period of time. In more detail, the conventional recording element is defective in that the density of the obtained image deteriorates with the lapse of time and consequently the image quality lowers, or the conventional recording element, which has been stored for a long period of time after preparation, can not produce a clear-cut image.

In contrast thereto, the photo-sensitive composition according to the present invention and the recording element using the same, as is seen from the examples referred to afterwards, can exhibit an excellent preservability by containing at least one kind of stabilizer selected from noble metal complexes, organic oxidants and organic acids. This mechanism is not always clarified but can be analyzed as follows. The reasons for deteriorating the preservability of the photo-sensitive and heat-sensitive composition are considered to comprise (1) dark reaction in which the cobalt (III) complex is decomposed by the cobalt (II) impurity contained therein; (2) dark reaction in which the ligand substitution is caused in the cobalt (III) complex by the action of the chelating agent (the basic substance is released from the cobalt (III) complex); and (3) dark reaction caused by the other reducing substance, i.e., the reducing substance contained in the photoreductant (e) (for instance, 9,10-dihydrophenanthrenequinone). However, it is to be noted that these dark reactions can be suppressed effectively by using the stabilizer. For instance, the organic oxidant or noble metal complex can oxidize the cobalt (II) complex into the cobalt (III) complex. Further, it is to be noted that the concurrent use of two kinds of stabilizers can achieve a more significant result. The concurrent use of the organic oxidant and the organic acid, still further, can attain the following results that said dark reactions (1) and (3) can be suppressed mainly by the action of the organic oxidant and the dark reaction (2) can be suppressed mainly by the action of the organic acid.

As the above description and examples referred to afterwards clarify, the photo-sensitive and heat-sensitive composition according to the present invention can provide an image having a high contrast and resolving power by widely increasing the fixing sensitivity without deteriorating the color generating sensitivity and further highly improving the preservability. In addition thereto, the photo-sensitive and heat-sensitive composition according to the present invention can obtain a positive image and a negative image selectively.

Figure 1:
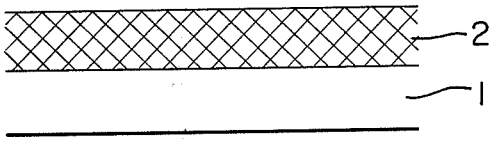
FIGS. 1 to 3 are each a cross-sectional view illustrating the construction embodiment of the recording element according to the present invention.
Figure 2:
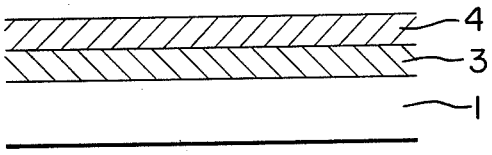
Figure 3:
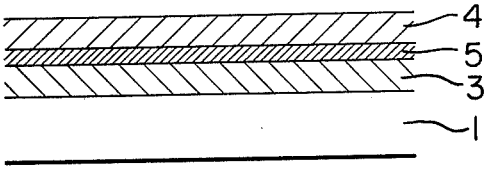

1 . . . a substrate,
2 . . . a photo-sensitive and heat-sensitive layer,
3 . . . a fixing layer,
4 . . . a color generating layer,
5 . . . an intermediate layer.

DESCRIPTION OF THE PREFERRED EMBODIMENTS

Comparative Example 1

A photo-sensitive and heat-sensitive layer-forming solution having the following composition was applied onto a 100 μm-thick polyethylene terephthalate film by means of a 4 mil doctor blade to thereby form a photo-sensitive and heat-sensitive layer. A control mono-layered recording element was thus obtained.

| | |
|---|---|
| acetone-isopropanol (volume ratio 9:1) | 10 ml |
| cellulose acetate butyrate | 1 g |
| 2,2'-bis(0-chlorophenyl)-4,4',5,5'-tetraphenyl-biimidazole | 132 mg |
| bis(4-diethylamino-0-tolyl)-4-diethylamino-phenylmethane | 48 mg |
| p-toluenesulfonic acid | 25 mg |
| polyethylene glycol | 400 ml |
| tris(ethylenediamine)cobalt(III)trifluoroacetate | 600 mg |
| 9,10-phenanthrenequinone | 30 mg |
| benzyldioxime | 250 mg |

The thus obtained recording element was stored in the dark at room temperature for a fixed period of time, then was subjected to a 15 seconds' imagewise exposure with a visible light having a spectral energy distribution of 400~500 nm and an intensity of 400 $\mu w/cm^2$, successively was thermally treated for 10 seconds on a stainless plate heated to 100° C., and thereafter was subjected to a 2 minutes' overall irradiation with an ultraviolet ray having an intensity of 150 $\mu w/cm^2$, whereby a clear-cut cyan image was obtained.

Examples 1 to 5

Recording elements according to the present invention were obtained by repeating the exactly same procedure as shown in Comparative Example 1 with the exception that organic oxidants or noble metal complexes shown in Table-1 were further added to the photo-sensitive and heat-sensitive layer-forming solution in the respective quantities as prescribed in Table-1. These recording elements were treated according to the same procedure as Comparative Example 1 to thereby obtain a clear-cut cyan image respectively.

The recording elements obtained according to the above Examples and Comparative Example 1 were measured with reference to the changes of the image area density and the background area density with the lapse of time. The thus obtained results are as shown in Table-1. In this connection, it is to be noted that the values indicated in the table are those measured by means of a reflection densitometer (cyan).

TABLE 1

| | Organic oxidant or noble metal complex | Quantity added (mg) | Days elasped | Image area density | Background area density |
|---|---|---|---|---|---|
| Comparative Example 1 | none | 0 | 0 | 1.8 | 0.4 |
| | | | 15 | 1.2 | 0.6 |
| | | | 30 | 1.0 | 0.6 |
| Example 1 | Imide N-bromo-succinate | 5 | 0 | 1.8 | 0.4 |
| | | | 15 | 1.8 | 0.4 |
| | | | 30 | 1.8 | 0.4 |
| Example 2 | Tetrachloro-phthalic anhydride | 8 | 0 | 1.8 | 0.4 |
| | | | 15 | 1.8 | 0.4 |
| | | | 30 | 1.8 | 0.4 |
| Example 3 | Pyradine-di-N-oxide | 5 | 0 | 1.8 | 0.4 |
| | | | 15 | 1.8 | 0.4 |
| | | | 30 | 1.8 | 0.4 |
| Example 4 | $HAuCl_4$ | 1 | 0 | 1.8 | 0.4 |
| | | | 15 | 1.8 | 0.4 |
| | | | 30 | 1.7 | 0.4 |
| Example 5 | $Pd(aa)_2$* | 2 | 0 | 1.8 | 0.4 |
| | | | 15 | 1.8 | 0.4 |
| | | | 30 | 1.7 | 0.4 |

*aa represents acetylacetone.

Comparative Example 2

A fixing layer-forming solution having the following composition was applied onto a 100$\mu$-thick polyethylene terephthalate film by means of a 2 mil doctor blade and dried at room temperature to thereby form a 6 $\mu$m-thick fixing layer.

| | |
|---|---|
| acetone isopropanol (volume ratio 9:1) | 10 ml |
| polyvinyl butyral | 1 g |
| hexaamminecobalt (III) trifluoroacetate | 500 mg |
| dimethylglyoxime | 120 mg |
| 9,10-phenanthrenequinone | 60 mg |

Next, a 10 wt.% aqueous solution of polyvinyl alcohol was applied thereon by means of a 2 mil doctor blade and a 23 $\mu$m spacer and dried at 50° C. for 20 minutes to thereby form a 4 $\mu$m-thick intermediate layer.

Further, a color generating layer-forming solution having the following composition was applied thereon by means of a 4 mil doctor blade and a 23 $\mu$m spacer and dried at room temperature to thereby form a 8 $\mu$m-thick color generating layer. Thus, there was obtained a three-layered recording element of Comparative Example type.

| | |
|---|---|
| acetone-isopropanol (volume ratio 9:1) | 10 ml |
| polyvinyl butyral | 1 g |
| bis(4-diethylamino-0-tolyl)-4-diethylamino-phenylmethane | 50 mg |
| 2,2'-bis(0-chlorophenyl)-4,4',5,5'-tetraphenyl-biimidazole | 132 mg |
| p-toluenesulfonic acid | 30 mg |
| polyethylene glycol | 400 mg |

The thus obtained recording element was stored in the dark at room temperature for a fixed period of time, then was subjected to a 10 seconds' imagewise exposure with a visible light having a spectral energy distribution of 400–500 nm and an intensity of 400 $\mu W/cm^2$, successively was thermally treated for 15 seconds on a stainless plate heated to 90° C., and thereafter was subjected to a 2 minutes' overall irradiation with an ultraviolet ray having an intensity of 150 $\mu W/cm^2$, whereby a clear-cut cyan image was obtained.

Examples 6 to 9

Recording elements according to the present invention were prepared by repeating the exactly same procedure as Comparative Example 2 with the exception that the fixing layer-forming solution was further added with the organic oxidants or noble metal complex shown in Table-2 in the respective quantities specified in Table-2 and the heating treatment on the stainless plate was carried out for the period of time specified in Table-2 respectively. The thus obtained recording elements were treated according to the same procedure as Comparative Example 2, whereby clear-cut cyan images were obtained respectively.

These recording elements and that according to Comparative Example 2 were measured in respect of the changes in the image area density and background area density with the lapse of time. The thus measured results are as shown in Table-2.

TABLE 2

| | Organic oxidant or noble metal complex | Quantity added (mg) | Heating time (second) | Days elapsed | Image area density | Background area density |
|---|---|---|---|---|---|---|
| Comparative Example 2 | none | 0 | 15 | 0 | 1.9 | 0.4 |
| | | | | 15 | 1.3 | 0.5 |
| | | | | 30 | 1.0 | 0.6 |
| Example 6 | Imide-N-bromosuccinate | 8 | 60 | 0 | 2.0 | 0.4 |
| | | | | 15 | 2.1 | 0.4 |
| | | | | 30 | 2.0 | 0.5 |
| Example 7 | Tetrachlorophthalic anhydride | 8 | 60 | 0 | 2.0 | 0.4 |
| | | | | 15 | 2.0 | 0.5 |
| | | | | 30 | 2.0 | 0.4 |
| Example 8 | Tetrachloro-p-benzoquinone | 4 | 30 | 0 | 2.1 | 0.5 |
| | | | | 15 | 2.0 | 0.5 |
| | | | | 30 | 2.1 | 0.5 |
| Example 9 | $HAuCl_4$ | 10 | 30 | 0 | 2.0 | 0.4 |
| | | | | 15 | 2.0 | 0.4 |
| | | | | 30 | 2.0 | 0.4 |

Example 10

| | |
|---|---|
| acetone-isopropanol (volume ratio 9:1) mixed solvent | 10 ml |
| polyvinyl butyral resin (S-Lec BM-2 available from Sekisui Kagaku K.K.) | 1 g |
| hexaminecobalt (III) trifluoroacetate | 500 mg |
| 9,10-phenanthrenequinone | 60 mg |

A mixed solution having the above composition was applied onto a 100μ-thick polyester film by means of a 2 mil doctor blade and the same was dried at room temperature to thereby form a 4μ-thick fixing layer. Subsequently, a 10 wt.% aqueous solution of PVA was applied onto the thus formed layer by means of a 2 mil doctor blade and a 100μ spacer and then the same was dried at 50° C. for 10 minutes to thereby form a 3μ-thick intermediate layer. Still further, a solution having the following composition was applied onto said layer by means of a 4 mil doctor blade and a 15μ spacer and then the same was dried at room temperature to thereby form a 7μ-thick color generating layer.

| | |
|---|---|
| acetone-isopanol (9:1 vol.%) | 10 ml |
| polyvinyl butyral resin (S-Lec BM-5 available from Sekisui Kagaku K.K.) | 1 g |
| 2,2'-bis(chlorophenyl)-4,4',5,5'-tetraphenylbiimidazole | 132 mg |
| bis(4-diethylamino-0-tolyl)-4-diethylaminophenylmethane | 50 mg |
| polyethylene glycol | 0.4 g |
| p-toluene sulfonic acid | 40 mg |

The thus obtained recording element was subjected from the substrate side to a 20 seconds' imagewise exposure with a visible light having an intensity of 400 $\mu W/cm^2$, then was heated for 15 seconds on a plate heated to 100° C., and successively was subjected from the color generating layer side to a 60 seconds' overall irradiation with an ultraviolet ray having an intensity of 150 $\mu W/cm^2$, whereby there was formed a positive-positive cyan color image having an image area density of 1.8 and a background area density of 0.31. In this connection, it is to be noted that the same results can also be obtained even when the imagewise exposure and ultraviolet ray irradiation are applied from either the color generating layer side or the substrate side.

Next, the recording element obtained according to the above procedure was compared in preservability with the recording element (Comparative Example 3) prepared by the same procedure as Example 10 with the exception that the organic acid was removed from the fixing layer. The obtained results are as shown in Table-3. The comparison was effected in the manner of preserving the samples after the image formation within a desiccator maintained at room temperature for 3, 7 and 30 days respectively for the measurement of changes in the image area density or background area density thereof.

TABLE 3

| | Time preserved | | | |
|---|---|---|---|---|
| | 0 day | 3 days | 7 days | 30 days |
| Example 10 | 1.81 | 1.75 | 1.66 | 1.41 |
| Comparative Example 3 | 1.76 | 1.00 | 0.81 | 0.55 |

(Note) The values shown in the table are those of the image area density.

Example 11

A fixing layer-forming solution having the following composition was applied onto a 100 μm-thick polyester film by means of a doctor blade and the same was dried at room temperature to thereby form a 6 μm-thick fixing layer.

| | |
|---|---|
| acetone-isopropanol (4:1 vol.%) | 10 ml |
| polyvinyl butyral | 1 g |
| hexaammine (III) trifluoroacetate | 500 mg |
| 9,10-phenanthrenequinone | 60 mg |
| polyethylene glycol | 300 mg |
| dimethylglyoxime | 120 mg |
| paratoluene sulfonic acid | 15 mg |
| 0-iodoso benzoic acid | 10 mg |

A 10 wt.% aqueous solution of polyvinyl alcohol was applied further onto the formed layer by means of a 2 mil doctor blade and a 23 μm-thick spacer, and the same was dried at 50° C. for 20 minutes to thereby form a 4 μm-thick intermediate layer.

A solution having the following composition was applied moreover onto the thus formed layer by means of a 2 mil doctor blade and a 50 μm-thick spacer and the same was dried at room temperature to thereby form a 8 μm-thick color generating layer. The recording element according to the present invention was thus prepared.

| | |
|---|---|
| acetone | 10 ml |
| cellulose acetate butyrate | 1 g |

-continued

| | |
|---|---|
| 2,2'-(bis-0-chlorophenyl)-4,4',5,5'-tetraphenyl-biimidazole | 132 mg |
| bis(4-diethylamino-0-tolyl)-4-diethylamino-phenylmethane | 50 mg |
| p-toluene sulfonic acid | 30 mg |
| polyethylene glycol | 300 mg |

This recording element was subjected to a 10 seconds' imagewise exposure by using a visible light source having a spectral energy distribution of 400 to 500 nm and under the condition where a recording surface exposure energy $=400\ \mu W/cm^2$, successively the same was treated for 10 seconds on a stainless plate heated to 100° C. and thereafter was subjected to a 60 seconds' overall exposure by an ultraviolet ray source having an intensity of $150\ \mu W/cm^2$, whereby there was obtained a clear-cut cyan image having an image area density of 1.8 and a background area density of 0.4. In this connection, it is to be noted that the density values are those measured by means of a Macbeth densitometer.

The thus obtained recording element according to the present invention was each stored for 15 and 30 days in the dark at room temperature without forming an image thereon immediately, and thereafter was subjected to the same image forming treatment as employed previously. The obtained results are shown in Table-4 together with those obtained from the recording element subjected immediately to the image forming treatment.

TABLE 4

| Days stored (day) | Image area density | Background area density |
|---|---|---|
| 0 | 1.8 | 0.4 |
| 15 | 1.7 | 0.4 |
| 30 | 1.6 | 0.5 |

Example 12

A recording element was obtained according to the exactly same procedure as Example 11 with the exception that the p-toluene sulfonic acid was removed from the components constituting the fixing layer-forming solution.

The thus obtained recording element was stored in the dark at room temperature for 30 days. Then, an image was formed thereon according to the same procedure as Example 11, the image area density and background area density thereof being 1.3 and 0.5 respectively.

Example 13

A recording element was obtained according to the exactly same procedure as Example 11 with the exception that the 0-iodoso benzoic acid was removed from the components constituting the fixing layer.

The thus obtained recording element was stored in the dark at room temperature for 30 days, and then an image was formed thereon according to the exactly same procedure as Example 11, which was found to have an image area density of 1.4 and a background area concentration of 0.5.

As is evident from the aforegoing, it can be seen that the recording element whose fixing layer contains both the organic acid and organic oxidant exhibits a more superior preservability as compared with the recording element whose fixing layer lacks either of both components.

Example 14

A recording element was obtained according to the exactly same procedure as Example 11 with the exception that the intermediate layer was not formed. An image was formed thereon according to the exactly same procedure as Example 11. The thus prepared recording element was measured in respect of the preservability. The obtained results are as shown in Table-5.

TABLE 5

| Days stored (day) | Image area density | Background area density |
|---|---|---|
| 0 | 1.3 | 0.4 |
| 15 | 1.3 | 0.4 |
| 30 | 1.2 | 0.4 |

This recording element showed to have an image area density lower than that of the recording element of Example 11, but exhibited a preservability more superior than that.

Examples 15 to 16

Recording elements according to the present invention were obtained by repeating the exactly same procedure as Example 11 with the exception that the compounds shown in Table-6 were employed, as the organic oxidants and organic acids constituting the fixing layer-forming solution, in place of the 0-iodoso benzoic acid and p-toluene sulfonic acid respectively. An image was formed thereon respectively according to the same procedure as Example 11. The thus obtained recording elements were measured in respect of the preservability, too. The obtained results are as shown in Table-6.

TABLE 6

| | | | Days stored: 0 | | Days stored: 30 | |
|---|---|---|---|---|---|---|
| Example | Organic oxidant | Organic acid | Image area density | Background area density | Image area density | Background area density |
| 15 | Imide N-bromo succinate | Tartaric acid | 1.7 | 0.4 | 1.6 | 0.4 |
| 16 | Tetrachloro phthalic anhydride | Maleic acid | 1.8 | 0.3 | 1.6 | 0.4 |

What is claimed is:

1. A photo-sensitive and heat-sensitive composition which comprises (a) a photooxidant, (b) a color-generator generating color when oxidized, (c) an acid promoting said color generation, (d) a cobalt (III) amine and/or amine complex, (e) a photoreductant, (f) a hydrogen donator, (g) at least one kind of chelating agent selected from dioxime chelating agents having the following general formula (I):

$$R_1-\underset{\underset{NOH}{\|}}{C}-(CH_2)_n-\underset{\underset{NOX}{\|}}{C}-R_2 \qquad (I)$$

(wherein n is an integer of 0 to 3, and $R_1$ and $R_2$ can each represent an alkyl, aryl or aralkyl group) and diantipyrylmethane chelating agents having the following general formula (II):

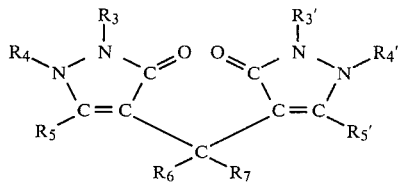

(II)

(wherein $R_3$, $R_4$, $R_5$, $R_3'$, $R_4'$ and $R_5'$ can each represent a hydrogen atom and an alkyl or aryl group, and $R_6$ and $R_7$ can each represent a hydrogen atom and an alkyl, substituted or non-substituted aryl or aralkyl group), and (h) at least one kind of stabilizer selected from noble metal complexes, organic oxidants and organic acids.

2. A photo-sensitive and heat-sensitive composition as claimed in claim 1 wherein the quantities of the (c) acid promoting the color generation, (a) photooxidant, (d) cobalt (III) complex, (e) photoreductant and (g) chelating agent are about 1–10 moles, about 0.1–10 moles, about 0.1–10 moles, about 0.1–10 moles and 0.1–10 moles respectively per mole of the (b) color-generator; the quantity of the (f) hydrogen donator is at least about 0.1 mole per mole of the (e) photoreductant, and the quantities of the noble metal complex, organic oxidant and organic acid are about 0.001–1 mole, about 0.001–1 mole and about 0.01–10 moles respectively per mole of the (e) photoreductant.

3. A photo-sensitive and heat-sensitive composition as claimed in claim 1 wherein the (g) chelating agent is a dioxime chelating agent having the following general formula (I):

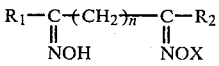

(I)

(wherein n is an integer of 0 to 3, and $R_1$ and $R_2$ can each represent an alkyl, aryl or aralkyl group).

4. A photo-sensitive and heat-sensitive composition as claimed in claim 1 wherein the (e) photoreductant is quinone.

5. A photo-sensitive and heat-sensitive composition as claimed in claim 1 wherein the (e) photoreductant is a polynuclear quinone.

6. A photo-sensitive and heat-sensitive composition as claimed in claim 1 wherein the (b) color-generator is leuco-aminotriarylmethane.

7. A photo-sensitive and heat-sensitive composition as claimed in claim 6 wherein the (a) photooxidant is hexaarylbiimidazole.

8. A photo-sensitive and heat-sensitive composition as claimed in claim 1 which contains, as the (h) stabilizer, both the organic oxidant and organic acid.

9. A photo-sensitive and heat-sensitive composition as claimed in claim 8 wherein the quantities of the organic oxidant and organic acid are each about 0.05–5 moles per mole of the (e) photoreductant.

10. A photo-sensitive and heat-sensitive composition as claimed in claim 1 further containing a binder.

11. A photo-sensitive and heat-sensitive composition as claimed in claim 10 wherein the quantity of said binder is in the range of about 30–90 wt.% of the total weight of the composition.

12. A recording element which comprises a substrate and a photosensitive and heat-sensitive layer, superposed on said substrate, consisting essentially of (a) a photooxidant, (b) a color-generator generating color when oxidized, (c) an acid promoting said color generation, (d) a cobalt (III) amine and/or amine complex, (e) a photoreductant, (f) a hydrogen donator, (g) at least one kind of chelating agent selected from dioxime chelating agents having the general formula (I):

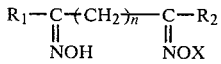

(I)

(wherein n is an integer of 0 to 3, and $R_1$ and $R_2$ can each represent an alkyl, aryl or aralkyl group) and diantipyrylmethane chelating agents having the following general formula (II):

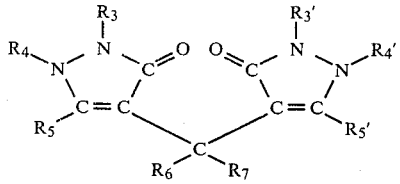

(II)

(wherein $R_3$, $R_4$, $R_5$, $R_3'$, $R_4'$ and $R_5'$ can each represent a hydrogen atom and an alkyl or aryl group, and $R_6$ and $R_7$ can each represent a hydrogen atom and an alkyl, substituted or non-substituted alkyl or aralkyl group), and (h) at least one kind of stabilizer selected from noble metal complexes, organic oxidants and organic acids.

13. A recording element as claimed in claim 12 wherein the quantities of the (c) acid promoting the color generation, (e) photooxidant, (d) cobalt (III) complex, (e) photoreductant and (g) chelating agent are about 1–10 moles, about 0.1–10 moles, about 0.1–10 moles, about 0.1–10 moles and 0.1–10 moles respectively per mole of the (b) color-generator; the quantity of the (f) hydrogen donator is at least about 0.1 mole per mole of the (e) photoreductant; and the quantities of the noble metal complex, organic oxidant and organic acid are about 0.001–1 mole, about 0.001–1 mole and about 0.01–10 moles respectively per mole of the (e) photoreductant.

14. A recording element as claimed in claim 12 wherein the photo-sensitive and heat-sensitive layer further contains a binder.

15. A recording element as claimed in claim 14 wherein the binder is contained in the photo-sensitive and heat-sensitive layer in a quantity of about 30–90 wt.%.

16. A recording element as claimed in claim 12 wherein the film thickness of the photo-sensitive and heat-sensitive layer is in the range of about 1–20 μm.

17. A recording element as claimed in claim 12 wherein the (g) chelating agent is a dioxime chelating agent having the following general formula (I):

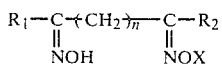

(I)

(wherein n is an integer of 0 to 3, and $R_1$ and $R_2$ can each represent an alkyl, aryl or aralkyl group).

18. A recording element as claimed in claim 12 wherein the (e) photoreductant is quinone.

19. A recording element as claimed in claim 12 wherein the (e) photoreductant is a polynuclear quinone.

20. A recording element as claimed in claim 12 wherein the (b) color-generator is leuco-aminotriarylmethane.

21. A recording element as claimed in claim 20 wherein the (a) photooxidant is hexaarylbiimidazole.

22. A recording element as claimed in claim 12 which contains, as the (h) stabilizer, both the organic oxidant and organic acid.

23. A recording element as claimed in claim 22 wherein the quantities of the organic oxidant and organic acid are each about 0.05–5 moles per mole of the (e) photoreductant.

24. A recording element which comprises a laminate, on a substrate, of (1) a fixing layer consisting essentially of (d) a cobalt (III) ammine and/or amine complex, (e) a photoreductant, (f) a hydrogen donator, (g) at least one kind of chelating agent selected from dioxime chelating agents having the following general formula (I):

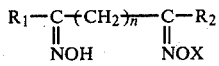

(I)

(wherein n is an integer of 0 to 3, and $R_1$ and $R_2$ can each represent an alkyl, aryl or aralkyl group) and diantipyrylmethane chelating agents having the following general formula (II):

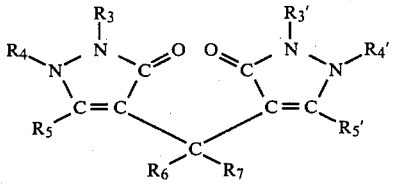

(II)

(wherein $R_3$, $R_4$, $R_5$, $R_3'$, $R_4'$ and $R_5'$ can each represent a hydrogen atom and an alkyl or aryl group, and $R_6$ and $R_7$ can each represent a hydrogen atom and an alkyl, substituted or non-substituted aryl or aralkyl group), and (h) at least one kind of stabilizer selected from noble metal complexes, organic oxidants and organic acids; and (2) a color generating layer consisting essentially of (a) a photooxidant, (b) a color-generator generating color when oxidized and (c) an acid promoting the color generation.

25. A recording element as claimed in claim 24 wherein the quantities of the (c) acid promoting the color generation, (a) photooxidant, (d) cobalt (III) complex, (e) photoreductant and (g) chelating agent are about 1–10 moles, about 0.1–10 moles, about 0.1–10 moles, about 0.1–10 moles and 0.1–10 moles respectively per mole of the (b) color generator; the quantity of the (f) hydrogen donator is at least about 0.1 mole per mole of the (e) photoreductant; and the quantities of the noble metal complex, organic oxidant and organic acid are about 0.001–1 mole, about 0.001–1 mole and about 0.01–10 moles respectively per mole of the (e) photoreductant.

26. A recording element as claimed in claim 24 wherein the fixing layer and the color generating layer further contain a binder respectively.

27. A recording element as claimed in claim 26 wherein the binder is contained in the fixing layer and the color generating layer in a quantity of about 30–90 wt.% respectively.

28. A recording element as claimed in claim 24 wherein the film thickness of each of the fixing layer and color generating layer is about 1–20 μm.

29. A recording element as claimed in claim 24 wherein the (g) chelating agent is a dioxime chelating agent having the following general formula (I):

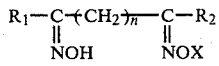

(I)

(wherein n is an integer of 0 to 3, and $R_1$ and $R_2$ can each represent an alkyl, aryl or aralkyl group).

30. A recording element as claimed in claim 24 wherein the (e) photoreductant is quinone.

31. A recording element as claimed in claim 24 wherein the (e) photoreductant is a polynuclear quinone.

32. A recording element as claimed in claim 24 wherein the (b) color-generator is leuco-aminotriarylmethane.

33. A recording element as claimed in claim 32 wherein the (a) photooxidant is hexaarylbiimidazole.

34. A recording element as claimed in claim 24 which contains, as the (h) stabilizer, both the organic oxidant and organic acid.

35. A recording element as claimed in claim 34 wherein the quantities of the organic oxidant and organic acid are each about 0.05–5 moles per mole of the (e) photoreductant.

36. A recording element which comprises a laminate, on a substrate, of (1) a fixing layer consisting essentially of (d) a cobalt (III) ammine and/or amine complex, (e) a photoreductant, (f) a hydrogen donator, (g) at least one kind of chelating agent selected from dioxime chelating agents having the following general formula (I):

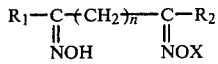

(I)

(wherein n is an integer of 0 to 3, and $R_1$ and $R_2$ can each represent an alkyl, aryl or aralkyl group) and diantipyrylmethane chelating agents having the following general formula (II):

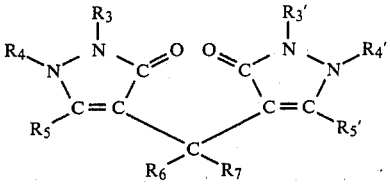

(II)

(wherein $R_3$, $R_4$, $R_5$, $R_3'$, $R_4'$ and $R_5'$ can each represent a hydrogen atom and an alkyl or aryl group, and $R_6$ and $R_7$ can each represent a hydrogen atom and an alkyl, substituted or non-substituted aryl or aralkyl group), and (h) at least one kind of stabilizer selected from noble metal complexes, organic oxidants and organic acids;

(2) an intermediate layer comprising resin; and (3) a color generating layer consisting essentially of (a) a photooxidant, (b) a color-generator generating color when oxidized and (c) an acid promoting the color generation.

37. A recording element as claimed in claim 36 wherein the quantities of the (c) acid promoting the color generation, (a) photooxidant, (d) cobalt (III) complex, (e) photoreductant and (g) chelating agent are about 1–10 moles, about 0.1–10 moles, about 0.1–10 moles, about 0.1–10 moles and 0.1–10 moles respectively per mole of the (b) color-generator; the quantity of the (f) hydrogen donator is at least about 0.1 mole per mole of the (e) photoreductant; and the quantities of the noble metal complex, organic oxidant and organic acid are about 0.001–1 mole, about 0.001–1 mole and about 0.01–10 moles respectively per mole of the (e) photoreductant.

38. A recording element as claimed in claim 36 wherein the fixing layer and color generating layer further contain a binder respectively.

39. A recording element as claimed in claim 38 wherein the binder is contained in the fixing layer and color generating layer in a quantity of about 30–90 wt.% respectively.

40. A recording element as claimed in claim 36 wherein the film thickness of the fixing layer is about 1–20 μm, the film thickness of the intermediate layer is about 1–10 μm, and the film thickness of the color generating layer is about 1–20 μm.

41. A recording element as claimed in claim 36 wherein the intermediate layer comprises a water soluble resin and/or emulsion-forming resin.

42. A recording element as claimed in claim 36 wherein the (g) chelating agent is a dioxime chelating agent having the following general formula (I):

$$R_1-\underset{\underset{NOH}{\|}}{C}-(CH_2)_n-\underset{\underset{NOX}{\|}}{C}-R_2 \qquad (I)$$

(wherein n is an integer of 0 to 3, and $R_1$ and $R_2$ can each represent an alkyl, aryl or aralkyl group).

43. A recording element as claimed in claim 36 wherein the (e) photoreductant is quinone.

44. A recording element as claimed in claim 36 wherein the (e) photoreductant is a polynuclear quinone.

45. A recording element as claimed in claim 36 wherein the color-generator is leuco-aminotriarylmethane.

46. A recording element as claimed in claim 45 wherein the (a) photooxidant is hexaarylbiimidazole.

47. A recording element as claimed in claim 36 which contains, as the (h) stabilizer, both the organic oxidant and the organic acid.

48. A recording element as claimed in claim 47 wherein the quantity of each of the organic oxidant and the organic acid is about 0.05–5 moles per mole of the (e) photoreductant.

* * * * *

UNITED STATES PATENT AND TRADEMARK OFFICE

CERTIFICATE OF CORRECTION

PATENT NO. : 4 315 068

DATED : February 9, 1982

INVENTOR(S) : Makoto Kunikane et al

It is certified that error appears in the above—identified patent and that said Letters Patent is hereby corrected as shown below:

At the locations listed below, i.e.,

Column 30, line 65;
Column 31, line 40;
Column 32, line 15;
Column 32, line 65;
Column 33, line 29;
Column 34, line 15;
Column 34, line 48; and
Column 36, line 10;

change the formula to read as follows:

$$--- R_1 - \underset{\underset{NOH}{\|}}{C} \left( CH_2 \right)_n \underset{\underset{NOH}{\|}}{C} - R_2 \quad ---.$$

Column 30, line 59; change "amine" to ---ammine---.

Column 32, line 8; change "amine" (first occurrence) to ---ammine---.

UNITED STATES PATENT AND TRADEMARK OFFICE

CERTIFICATE OF CORRECTION

PATENT NO. : 4 315 068

DATED : February 9, 1982

INVENTOR(S) : Makoto Kunikane et al

It is certified that error appears in the above—identified patent and that said Letters Patent is hereby corrected as shown below:

Column 32, line 34; change "alkyl" to ---aryl---.

Column 32, line 39; change "(e)" to ---(a)---.

Signed and Sealed this

*Fourth* Day of *May 1982*

[SEAL]

*Attest:*

GERALD J. MOSSINGHOFF

*Attesting Officer* *Commissioner of Patents and Trademarks*